US011939121B2

(12) United States Patent
Donschietz et al.

(10) Patent No.: US 11,939,121 B2
(45) Date of Patent: Mar. 26, 2024

(54) ZIPPER CARTONS WITH RESEAL PANELS AND METHODS OF USE AND ASSEMBLY

(71) Applicant: FISHER CLINICAL SERVICES, INC., Allentown, PA (US)

(72) Inventors: Michael T. Donschietz, Macungie, PA (US); Tyler S. Kovitch, Collegeville, PA (US)

(73) Assignee: FISHER CLINICAL SERVICES, INC., Allentown, PA (US)

( * ) Notice: Subject to any disclaimer, the term of this patent is extended or adjusted under 35 U.S.C. 154(b) by 134 days.

(21) Appl. No.: 16/886,052

(22) Filed: May 28, 2020

(65) Prior Publication Data

US 2020/0391903 A1 Dec. 17, 2020

Related U.S. Application Data

(60) Provisional application No. 62/860,099, filed on Jun. 11, 2019.

(51) Int. Cl.
*B65D 5/54* (2006.01)
*B65D 5/20* (2006.01)
(Continued)

(52) U.S. Cl.
CPC ..... *B65D 5/546* (2013.01); *B65D 5/2052* (2013.01); *B65D 5/2057* (2013.01);
(Continued)

(58) Field of Classification Search
CPC ... B65D 5/546; B65D 2517/50; B65D 5/2057
(Continued)

(56) References Cited

U.S. PATENT DOCUMENTS 1,745,770 A * 2/1930 Shapiro ..... B65D 5/2057 229/157
2,388,288 A * 11/1945 Ringler ..... B65D 75/02 229/125.21
(Continued)

FOREIGN PATENT DOCUMENTS

DE 75 08 653 U 9/1976
DE 94 09 968 U1 9/1994
(Continued)

OTHER PUBLICATIONS

*Handbook of Folding Carton Style Nomenclature*, Paperboard Packaging council, 1992, 4 pages.
*Fibre Box Handbook*, Fibre Box Association, 1999, 4 pages.

*Primary Examiner* — Ernesto A Grano
*Assistant Examiner* — Symren K Sanghera
(74) *Attorney, Agent, or Firm* — Michael Best & Friedrich LLP

(57) ABSTRACT

A zipper carton includes a first panel having an elongated slot extending therethrough, the slot having a length extending between opposing ends. A locking panel assembly includes a removable zipper tear strip and a locking tab having a linear length that is greater than the length of the slot. The locking tab includes a base projecting from the removable zipper tear strip and a first retention flap projecting from the base and being foldable relative to the base. The locking tab is configured so that when the first retention flap is folded from a relaxed position to a folded position, at least a portion of the locking tab including the first retention flap can be slid through the slot and after the first retention flap passes through the slot, the retention flap automatically resiliently rebounds at least partially toward the relaxed position so as to block retraction of the locking tab from the slot.

20 Claims, 22 Drawing Sheets

(51) Int. Cl.
*B65D 5/50* (2006.01)
*B65D 5/66* (2006.01)
*B65D 75/58* (2006.01)

(52) U.S. Cl.
CPC ..... *B65D 5/5014* (2013.01); *B65D 5/5021* (2013.01); *B65D 5/5455* (2013.01); *B65D 5/6658* (2013.01); *B65D 75/5805* (2013.01); *B65D 2255/20* (2013.01); *B65D 2517/0013* (2013.01)

(58) Field of Classification Search
USPC ..... 229/241
See application file for complete search history.

(56) References Cited

U.S. PATENT DOCUMENTS 2,690,286 A * 9/1954 Dawson ..... B65D 5/2057 229/155
3,462,066 A * 8/1969 Farquhar ..... B65D 5/106 229/102
3,510,047 A * 5/1970 Boehm ..... B65D 5/22 225/49
3,826,420 A * 7/1974 Bamburg ..... B65D 5/6664 229/102
3,869,079 A * 3/1975 Oglesbee ..... B65D 5/48038 206/139
4,015,767 A * 4/1977 Ferriter ..... B65D 5/02 229/122
4,046,311 A * 9/1977 Voytko ..... B65D 5/2057 229/921
4,174,041 A 11/1979 Turner
4,196,842 A * 4/1980 Focke ..... B65D 5/18 206/268
4,304,353 A * 12/1981 Stollberg ..... B65D 5/6644 206/509
4,401,258 A * 8/1983 Buchler ..... B65D 5/5038 206/521
4,746,052 A 5/1988 Schmissrauter
5,217,159 A * 6/1993 Calvert ..... B29C 66/4326 229/5.84
5,419,486 A * 5/1995 Bennett ..... B65D 5/546 493/162
5,642,854 A * 7/1997 Hatton ..... B65D 5/4295 229/128
5,950,914 A 9/1999 Dunton
6,199,688 B1 3/2001 Focke
6,223,980 B1 * 5/2001 Guillin ..... B65D 5/685 229/162.1
6,364,200 B1 * 4/2002 Moss ..... B65D 5/10 229/128
6,409,077 B1 6/2002 Telesca et al.
7,080,736 B2 7/2006 Jackson
8,025,209 B2 9/2011 Garner
8,308,363 B2 11/2012 Vogt
8,998,074 B2 4/2015 Schomisch
9,663,265 B1 * 5/2017 Olds ..... B65D 5/103
10,577,144 B2 3/2020 Buss
2002/0036230 A1 * 3/2002 Chevalier ..... B65D 5/6626 229/145
2005/0145683 A1 7/2005 Alagna
2005/0173291 A1 * 8/2005 Specker ..... B65D 5/2009 206/534.2
2007/0170234 A1 * 7/2007 Cargile, Jr. ..... B65D 71/36 229/157
2009/0057387 A1 * 3/2009 Tirado Alanis ..... B65D 5/2057 229/145
2013/0087607 A1 * 4/2013 Learn ..... B65D 5/667 229/124
2014/0102934 A1 4/2014 Gatto et al.
2014/0305944 A1 * 10/2014 Lahlouh ..... B65D 5/546 229/125.33
2015/0251797 A1 * 9/2015 Carman ..... B65D 5/304 229/148
2016/0137335 A1 5/2016 Mora
2016/0236811 A1 8/2016 Jensen
2017/0057690 A1 3/2017 Boersma
2017/0158372 A1 * 6/2017 Faulkner ..... B65D 5/244
2017/0334614 A1 * 11/2017 Herlin ..... B65D 51/20
2018/0215499 A1 8/2018 Imai
2019/0100346 A1 4/2019 Bressan et al.
2019/0127108 A1 5/2019 Bressan et al.
2019/0344927 A1 * 11/2019 Ozgercel ..... B65D 5/22
2020/0172317 A1 * 6/2020 Costanzo, Jr. ..... B31B 50/26

FOREIGN PATENT DOCUMENTS

DE 20 2012 003954 U1 7/2013
EP 1 481 922 A1 12/2004
GB 2 315 239 A 1/1998
JP 2016132490 A * 7/2016 ..... B65D 5/0254
WO 2015/170203 A1 11/2015

* cited by examiner

ZIPPER CARTONS WITH RESEAL PANELS AND METHODS OF USE AND ASSEMBLY

CROSS-REFERENCE TO RELATED APPLICATIONS

This application claims the benefit of Provisional Application No. 62/860,099, filed Jun. 11, 2019, which is incorporated herein by specific reference.

BACKGROUND

1. Technical Field

The present disclosure relates to cartons designed for housing and transporting drug products and for use in housing and transporting trial products used in blinded clinical trials. The present disclosure also relates to reseal panels that can be used with such cartons and to related methods of assembly and use.

2. The Relevant Technology

Clinical trials for many pharmaceutical drugs require that a drug and a placebo be delivered and administered in a blinded study. As part of the blinded clinical trial protocols, the drug and placebo are placed in separate unmarked containers. Accordingly, the administering technician and recipient are blind as to the identity of the product, the concentration thereof, or other characteristics being studied that may otherwise be reported on the retail label of the drug container.

To facilitate transport and delivery of the drug/placebo, the unmarked containers can be sealed in a box. For instance, an unmarked dosage vial or tube can be placed in a box having a lid that can be folded over to close the box. Once the lid is closed, a sealing sticker, often referred to as a tamper seal, is manually placed on the outside of the box so as to extend between the lid and the body of the box, thereby fixing the lid closed and sealing the contents therein. The unbroken sealing sticker indicates that the box has not been opened following sealing of the product therein, thereby ensuring that there has been no tampering with the product. The box can also be marked with a label that includes an identification number or other information associated with the included product. However, this identifying information is keyed to a reference list and is only useful in identifying the product in combination with that list. Accordingly, the box may also lack any direct, product-identifying marks or labels to ensure fidelity of the blinded study.

One of the difficulties in conducting blinded trials is ensuring that there is no indirect identifying and/or associating information that can inadvertently convey to the participants information about the drug/placebo they are taking. For instance, variation between the placement (e.g., location, orientation, etc.) of the sealing stickers on the boxes can provide an indication of product identity. Specifically, differences in the placement of sealing stickers between adjacent boxes or between current and former boxes may cause a participant to infer that the products between the two boxes are different or that one box is more likely to have an active drug as opposed to a placebo. Such perceived differences can defeat the objective of the blinded trials. Because even slight differences between the human-applied sealing stickers on two separate boxes can lead the technician or recipient to believe that the containers disposed therein contain different products, controlling such perceived differences can be vital to the efficacy and fidelity of the clinical trial.

Another problem associated with the above packaging of trial products is that it is frequently necessary to house and/or transport the drugs at freezing temperatures. Such freezing temperatures can occasionally result in failure of the adhesive on the sealing sticker which, in turn, can result in automatic opening of boxes or at least enable to boxes to be freely opened. Failure of the sealing sticker thus defeats the integrity of the blinded study because there is no longer any assurance that the corresponding boxes have not been opened to discern the contents therein.

In addition, boxes that are intentionally opened during a blinded study may need to be sealed or resealed for a variety of purposes without perceived differences between sealed or resealed boxes. Where a sealing sticker has been previously placed on the outside of a box, this can be difficult if not impossible to do.

Boxes using the above discussed sealing stickers are also frequently used for storing and transporting drug products, e.g., active, therapeutic drugs that have previously received clearance from the Food and Drug Administration (FDA) or other equivalent regulatory body, that are being sold in commerce. In those cases, the sealing stickers primary ensure that there has been no tampering with the drug product once the drug product has been placed within the box. In this context, many of the concerns associated with using sealing stickers in blinded clinical trials are also applicable for selling drug products. For example, some drug products also need to be shipped or stored at freezing temperatures that can result in failure of the sealing stickers. Where the sealing sticker has failed and the box can be freely opened, the integrity of the drug product can no longer be verified. Furthermore, it can occasionally be necessary to open a box containing a drug product, prior to sale, such as to exchange or update a drug product, product label, or product supplement. In that case, it can be desirable to reseal the box with minimal evidence of tampering.

In each of the above situations, it would also be desirable to have boxes that prevent sealed boxes from being improperly opened and resealed and/or that produce an indication of when a sealed box has been improperly opened or attempts have been made to improperly open.

Accordingly, what is needed in the art are boxes and assemblies that overcome all or some of the above shortcomings, including products and methods for sealing, opening, and/or resealing boxes in a manner that overcomes all or some of the above shortcomings.

SUMMARY OF THE INVENTION

Various independent aspects and examples consistent with the present teaching are set out in the following numbered clauses:

Clause 1: A zipper carton comprising:

- a first panel having an elongated slot extending therethrough, the slot having a length extending between opposing ends; and
- a locking panel assembly comprising:
  - a removable zipper tear strip; and
  - a locking tab having a linear length that is greater than the length of the slot, the locking tab comprising:
    - a base projecting from the removable zipper tear strip; and
    - a first retention flap projecting from the base and being foldable relative to the base, the locking tab being configured so that when the first retention flap is folded from a relaxed position to a folded position, at least a portion of the locking tab including the first retention flap can be slid through the slot and after the first retention flap passes through the slot, the retention flap automatically resiliently rebounds at least partially toward the relaxed position so as to block retraction of the locking tab from the slot.

Clause 2: The zipper carton as recited in clause 1, wherein a crease is formed at an intersection between the base and the first retention flap.

Clause 3: The zipper carton as recited in clause 1, wherein the locking tab further comprises a second retention flap projecting from the base and being foldable relative to the base.

Clause 4: The zipper carton as recited in clause 3, wherein the locking tab is configured so that when the first and second retention flaps are each folded from a relaxed position to a folded position, at least a portion of the locking tab including the first and second retention flaps can be slid through the slot and after the first and second retention flaps pass through the slot, the first and second retention flaps automatically resiliently rebound at least partially toward the relaxed positions so as to block retraction of the locking tab from the slot.

Clause 5: The zipper carton as recited in clause 3, wherein the base of the locking tab has a front face and an opposing back face that the longitudinally extend between a first side edge and an opposing second side edge, the first retention flap projecting from the first side edge of the base and the second retention flap projecting from the second side edge of the base.

Clause 6: The zipper carton as recited in clause 5, wherein when the first retention flap and the second retention flap are in the relaxed position, the first retention flap, the second retention flap and the base are disposed in a common plane.

Clause 7: The zipper carton as recited in clause 3, wherein the first retention flap and the second retention flap are each folded over an angle of at least 150° when they are folded from the relaxed position to the folded position.

Clause 8: The zipper carton as recited in clause 5, wherein the base has a linear length extending between the opposing first and second side edges, the linear length of the base being equal to or smaller than the length of the slot.

Clause 9: The zipper carton as recited in clause 3, wherein the locking tab further comprises a third retention flap projecting from the base and being foldable relative to the base.

Clause 10: The zipper carton as recited in clause 9, wherein the locking tab is configured so that when the first, second, and third retention flaps are each folded from a relaxed position to a folded position, at least a portion of the locking tab including the first, second, and third retention flaps can be slid through the slot and after the first, second, and third retention flaps pass through the slot, the first, second, and third retention flaps automatically resiliently rebound at least partially toward the relaxed positions so as to block retraction of the locking tab from the slot.

Clause 11: The zipper carton as recited in clause 9, wherein the base of the locking tab has a front face, an opposing back face, and a top edge that longitudinally extends between a first side edge and an opposing second side edge, the first retention flap projecting from the first side edge of the base, the second retention flap projecting from the second side edge of the base, and the third retention flap projecting from the top edge of the base.

Clause 12: The zipper carton as recited in clause 1, wherein the slot has a maximum width that is less than 3 mm.

Clause 13: The zipper carton as recited in clause 1, wherein the slot has a width that varies along the length of the slot.

Clause 14: The zipper carton as recited in clause 1, wherein the first panel and the locking panel assembly are each comprised of a flexible sheet of paper.

Clause 15: The zipper carton as recited in clause 1, wherein the first panel and the locking panel assembly are each free of any adhesive applied thereto.

Clause 16: The zipper carton as recited in clause 1, wherein the locking panel assembly further comprises an extension panel, the removable zipper tear strip being disposed between the extension panel and the locking tab.

Clause 17: The zipper carton as recited in clause 16, further comprising:

a first tuck flap projecting from a first side edge of the extension panel, a crease being formed at the first side edge; and a second tuck flap projecting from an opposing second side edge of the extension panel, a crease being formed at the second side edge.

Clause 18: The zipper carton as recited in clause 1, further comprising:

an encircling sidewall that partially bounds a compartment, the encircling sidewall having an upper end that bounds an access opening to the compartment and an opposing lower end;

a floor disposed at the lower end of the encircling sidewall; and the locking panel assembly being connected to the encircling sidewall.

Clause 19: The zipper carton as recited in clause 18, further comprising a drug product or trial product disposed within the compartment.

Clause 20: The zipper carton as recited in clause 19, wherein the trial product comprises an active drug, a comparator drug, or a placebo.

Clause 21: The zipper carton as recited in clause 18, further comprising:

a cover panel assembly projecting from the encircling sidewall, the cover panel assembly being configured to extend over and at least partially cover the access opening;

the locking panel assembly projecting from the cover panel assembly;

the first panel comprising a front panel of the encircling sidewall, the slot extending through the font panel so as to communicate with the compartment.

Clause 22: The zipper carton as recited in clause 21, wherein the cover panel assembly projects from an upper end of a back panel of the encircling sidewall that is opposite the front panel.

Clause 23: The zipper carton as recited in clause 21, wherein a secondary slot is formed at or adjacent to an intersection between the cover panel assembly and the locking panel assembly.

Clause 24: The zipper carton as recited in clause 18, further comprising:

the first panel projecting directly from a front panel the encircling sidewall, the first panel being configured to extend over and at least partially cover the access opening; and the locking panel assembly projecting directly from a back panel of the encircling sidewall.

Clause 25: A zipper carton in a closed and locked position, comprising:

the zipper carton as recited in clause 1;

at least a portion of the locking tab including the first retention flap being passed through the slot, the first retention flap being angled relative to the base so as to block retraction of the locking tab out of the slot.

Clause 26: The zipper carton in a closed and locked position as recited in clause 25, further comprising a second retention flap projecting from the base and being passed through the slot, the second retention flap being angled relative to the base so as to block retraction of the locking tab out of the slot.

Clause 27: The zipper carton in a closed and locked position as recited in clause 26, further comprising a third retention flap projecting from the base and being passed through the slot, the third retention flap being disposed between the first retention flap and the second retention flap so as to block folding of the first retention flap and the second retention flap toward the base.

Clause 28: The zipper carton in a closed and locked position as recited in clause 26, wherein the first retention flap and the second retention flap are inwardly folded toward the removable zipper tear strip.

Clause 29: The zipper carton in a closed and locked position as recited in clause 27, wherein the third retention flap is biased against a product retainer.

Clause 30: A method for closing a zipper carton, the method comprising:

providing the zipper carton as recited in clause 1;

folding the first retention flap from the relaxed position to the folded position;

passing the locking tab including the first retention flap through the slot; and allowing the first retention flap to automatically resiliently rebound at least partially toward the relaxed position so as to block retraction of the locking tab from the slot.

Clause 31: A method for closing a zipper carton, the method comprising:

providing the zipper carton as recited in clause 4;

folding the first retention flap and the second retention flap from the relaxed position to the folded position;

passing at least a portion of the locking tab including the first retention flap and the second retention flap through the slot; and allowing the first retention flap and the second retention flap to automatically resiliently rebound at least partially toward the relaxed position so as to block retraction of the locking tab from the slot.

Clause 32: A method for closing a zipper carton, the method comprising:

providing the zipper carton as recited in clause 9;

folding the first retention flap, the second retention flap and the third retention flap from the relaxed position to the folded position;

passing the locking tab including the first retention flap, the second retention flap and the third retention flap through the slot; and allowing the first retention flap, the second retention flap and the third retention flap to automatically resiliently rebound at least partially toward the relaxed position so as to block retraction of the locking tab from the slot.

Clause 33: The method as recited in clause 32, wherein the third retention flap is disposed between the first retention flap and the second retention flap so as to block folding of the first retention flap and the second retention flap back to the folded position when the first retention flap, the second retention flap and the third retention flap are resiliently rebounded at least partially toward the relaxed position.

Clause 34: The method as recited in clause 32, wherein the third retention flap is blocked by a product retainer as it resiliently rebounds at least partially toward the relaxed position.

Clause 35: A zipper carton comprising:

an encircling sidewall that partially bounds a compartment, the encircling sidewall having an upper end that bounds an access opening to the compartment and an opposing lower end, the encircling sidewall comprising a front panel having a slot that extends therethrough;

a floor disposed at the lower end of the encircling sidewall;

a cover panel assembly projecting from the upper end of encircling sidewall; and a locking panel assembly projecting from the cover panel assembly, the locking panel assembly comprising:

an locking tab; and a removable zipper tear strip disposed between the locking tab and the cover panel assembly, wherein the cover panel assembly and the locking panel assembly are movable between an open position wherein access opening to the compartment is open and a closed and locked position wherein the cover panel assembly covers the access opening and the locking tab is locked within the slot.

Clause 36: The zipper carton as recited in clause 35, wherein the cover panel assembly and the locking panel assembly are held in the closed and locked position without the use of an adhesive.

Clause 37: The zipper carton as recited in clause 35, wherein the encircling sidewall is self-supporting without the use of an adhesive.

Clause 38: The zipper carton as recited in clause 35, wherein no adhesive is applied to the locking panel assembly or the front panel.

Clause 39: The zipper carton as recited in clause 35, wherein the cover panel assembly, the locking panel assembly and the encircling sidewall are each comprised of a flexible sheet of paper.

Clause 40: The zipper carton as recited in clause 35, wherein the locking tab comprises:

a base projecting from the removable zipper tear strip; and a first retention flap projecting from the base and being foldable relative to the base.

Clause 41: The zipper carton as recited in clause 40, further comprising:

the base having a first side edge and an opposing second side edge with a linear length extending therebetween, the linear length of the base being equal to or small than the length of the slot; and the first retention flap projecting from the first side edge of the base.

Clause 42: The zipper carton as recited in clause 40, wherein the locking tab further comprises a second retention flap projecting from the base and being foldable relative to the base.

Clause 43: The zipper carton as recited in clause 42, wherein the locking tab further comprises a third retention flap projecting from the base and being foldable relative to the base.

Clause 44: The zipper carton as recited in clause 35, wherein the slot has an elongated length extending between opposing ends and the locking tab has a linear length extending between opposing terminal side edges, the liner length of the locking tab being greater than the length of the slot.

Clause 45: The zipper carton as recited in clause 35, wherein the locking panel assembly further comprises an extension panel extending between the cover panel assembly and the removable zipper tear strip.

Clause 46: A reseal panel comprising:

a primary locking tab comprising a base and a first retention flap projecting therefrom;

a secondary locking tab comprising a base and a first retention flap projecting therefrom; and a zipper tear strip disposed between the primary locking tab and the secondary locking tab.

Clause 47: The reseal panel as recited in clause 46, wherein the primary locking tab, the secondary locking tab and the zipper tear strip are each comprised of a flexible sheet of paper.

Clause 48: The reseal panel as recited in clause 46, wherein the primary locking tab, the secondary locking tab and the zipper tear strip are each free of any adhesive applied thereto.

Clause 49: The reseal panel as recited in clause 46, wherein the primary locking tab further comprises a second retention flap projecting from the base.

Clause 50: The reseal panel as recited in clause 49, wherein the primary locking tab further comprises a third retention flap projecting from the base.

Clause 51: The reseal panel as recited in clause 46, further comprising an extension panel extending between the zipper tear strip and the secondary locking tab.

Clause 52: A zipper carton comprising:

an encircling sidewall that partially bounds a compartment, the encircling sidewall having an upper end that bounds an access opening to the compartment and an opposing lower end, the encircling sidewall comprising a front panel having a slot that extends therethrough;

a floor disposed at the lower end of the encircling sidewall;

a cover panel assembly projecting from the upper end of encircling sidewall and being configured to cover the access opening to the compartment, a secondary slot extending through a portion of the cover panel assembly; and the reseal panel as recited in clause 46, the secondary locking tab being passed through the secondary slot.

Clause 53: A method for packaging a drug product or trial product, the method comprising:

inserting a drug product or trial product within a compartment of a carton body;

moving a cover panel assembly to cover an access opening to the compartment of the carton body, the cover panel assembly projecting from the carton body;

folding a locking tab of locking panel assembly into a collapsed position, the locking panel assembly projecting from either carton body or the cover panel assembly and comprising a removable zipper tear strip;

inserting the folded locking tab into a slot formed on either a panel of the carton body or on the cover panel assembly; and allowing the folded locking tab to at least partially resiliently unfold so that the locking tab is locked within the slot;

Clause 54: The method as recited in clause 53, further comprising removing the zipper tear strip so as to separate the locking tab from a remainder of the locking panel assembly.

Clause 55: The method as recited in clause 54, further comprising:

folding a secondary locking tab of a reseal panel into a collapsed position;

inserting the folded secondary locking tab into a secondary slot formed on either a panel of the carton body or on the cover panel assembly; and allowing the folded secondary locking tab to at least partially resiliently unfold so that the locking tab is secured within the secondary slot.

Clause 56: The method as recited in clause 55, further comprising:

folding a primary locking tab of a reseal panel into a collapsed position; and inserting the primary locking tab into the slot formed on either the panel of the carton body or on the cover panel assembly; and allowing the folded primary locking tab to at least partially resiliently unfold so that the primary locking tab is locked within the slot.

Each of the above independent aspects of the disclosure may include any of the features, options and possibilities set out in this document, including those under the other independent aspects, and may also include any combination of any of the features, options and possibilities set out in this document.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
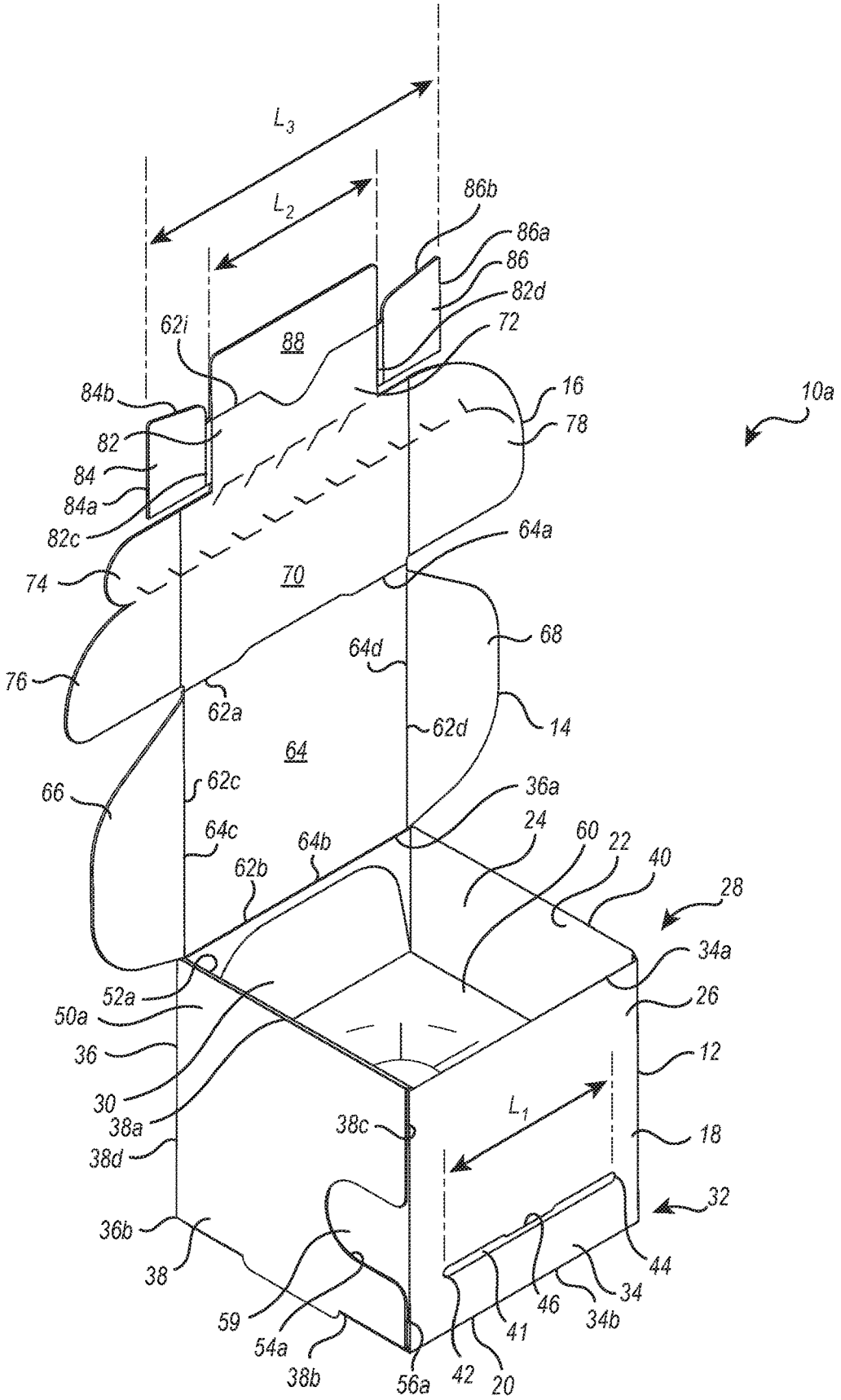
FIG. 1 is a front perspective view of one embodiment of a zipper carton in an erected and open position.

Before describing the present disclosure in detail, it is to be understood that this disclosure is not limited to parameters of the particularly exemplified systems, methods, apparatus, products, processes, compositions, and/or kits, which may, of course, vary. It is also to be understood that the terminology used herein is only for the purpose of describing particular embodiments of the present disclosure, and is not necessarily intended to limit the scope of the disclosure in any particular manner. Thus, while the present disclosure will be described in detail with reference to specific embodiments, features, aspects, configurations, etc., the descriptions are illustrative and are not to be construed as limiting the scope of the claimed invention. Various modifications can be made to the illustrated embodiments, features, aspects, configurations, etc. without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "alternative embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "panel" includes one, two, or more panels. As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. In addition, similar elements and/or elements having similar functions may be designated by similar numbering (e.g., element "10" and element "210.") Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. In contrast to using a letter, one or more prime symbols "′" can be appended to an element number and used in the same way as a letter. However, element labels including an appended letter or prime symbol are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

It is also noted that systems, methods, apparatus, devices, products, processes, compositions, and/or kits, etc., according to certain embodiments of the present invention may include, incorporate, or otherwise comprise properties, features, aspects, steps, components, members, and/or elements described in other embodiments disclosed and/or described herein. Thus, reference to a specific feature, aspect, steps, component, member, element, etc. in relation to one embodiment should not be construed as being limited to applications only within said embodiment. In addition, reference to a specific benefit, advantage, problem, solution, method of use, etc. in relation to one embodiment should not be construed as being limited to applications only within said embodiment.

The headings used herein are for organizational purposes only and are not meant to be used to limit the scope of the description or the claims. To facilitate understanding, like reference numerals have been used, where possible, to designate like elements common to the figures.

In general, the present disclosure is directed to zipper cartons that are designed to receive a drug product and/or a trial product, and to related methods of assembly and use. The term "drug product(s)," as used herein, refers to an active, therapeutic drug, such as one that has previously received clearance from the Food and Drug Administration (FDA) or other equivalent regulatory body so that it can be sold in commerce. In contrast, as discussed below in greater detail, the term "trial product(s)," as used herein, refers to a product being used in a blinded clinical trial and can include an active drug product that is under investigation, a related placebo product, a control product and/or a comparator product. In general, the zipper carton includes a carton body having a cover panel assembly extending therefrom that can used to cover and lock closed an access opening of the carton body. The carton can be configured with a removable zipper tear strip to enable opening the carton body to access a drug product or to access a trial product housed therein as part of a blinded trial. The present disclosure is also directed to reseal panels that can be used with the zipper cartons and methods of use. The reseal panels can attached to zipper cartons that have been opened by removal of the zipper strip to enable reclosing and relocking zipper cartons.

Accordingly, some embodiments of the zipper carton described herein can comprise a pre-assembled and/or erectable, disposable, sealable, single use box adapted for housing a drug product or assembling a blinded clinical trial kit. The zipper carton can be configured to receive one or more drug products/blinded trial products therein and can be erectable and sealable without the application of any adhesive or sealing agent. For instance, the zipper carton can be sealed in a secure manner without the use of adhesive on the zipper carton or by applying an external sealing tape or sealing sticker. More specifically, various embodiments of the zipper carton assembly described herein can be assembled, erected, formed, manipulated, closed and locked without the use of any adhesive material. For instance, some embodiments can include a flat zipper carton template that can be assembled, erected into a self-supporting zipper carton and then closed and locked after receiving a drug product/trial product without using a glue, sticker, tape or other form of adhesive to connect two portions of the template together.

Using an adhesive to assemble, erect, close or lock a zipper carton can be undesirable in the context where the drug product/trial product needs to be held at low or freezing temperatures, such as during transport or storage, since such temperatures can cause failure of the adhesive. In turn, failure of the adhesive can enable access to the drug product/trial product therein and thereby jeopardize the integrity of a blinded trial and/or bring into question the integrity of the product. Furthermore, the application of external sealing tape or stickers is typically undesirable because they can distinguish zipper cartons that includes an active trial product from a zipper carton that includes a placebo trial product and thus influence a blinded trial.

Thus, embodiments of the present disclosure provide a variety of advantages above and/or over know containers and/or provide unique solutions to problems in the art not otherwise addressed by existing containers. It is noted, however, that the present disclosure does not preclude the use of an adhesive, either independently or in the form of a sticker, tape, or the like, on or within the zipper cartons disclosed herein. Rather, the zipper cartons are configured so that if desired the use of adhesive can be eliminated or at least decreased. Various embodiments will now be discussed in further detail with reference being made to the Figures of the present disclosure.

Figure 2:
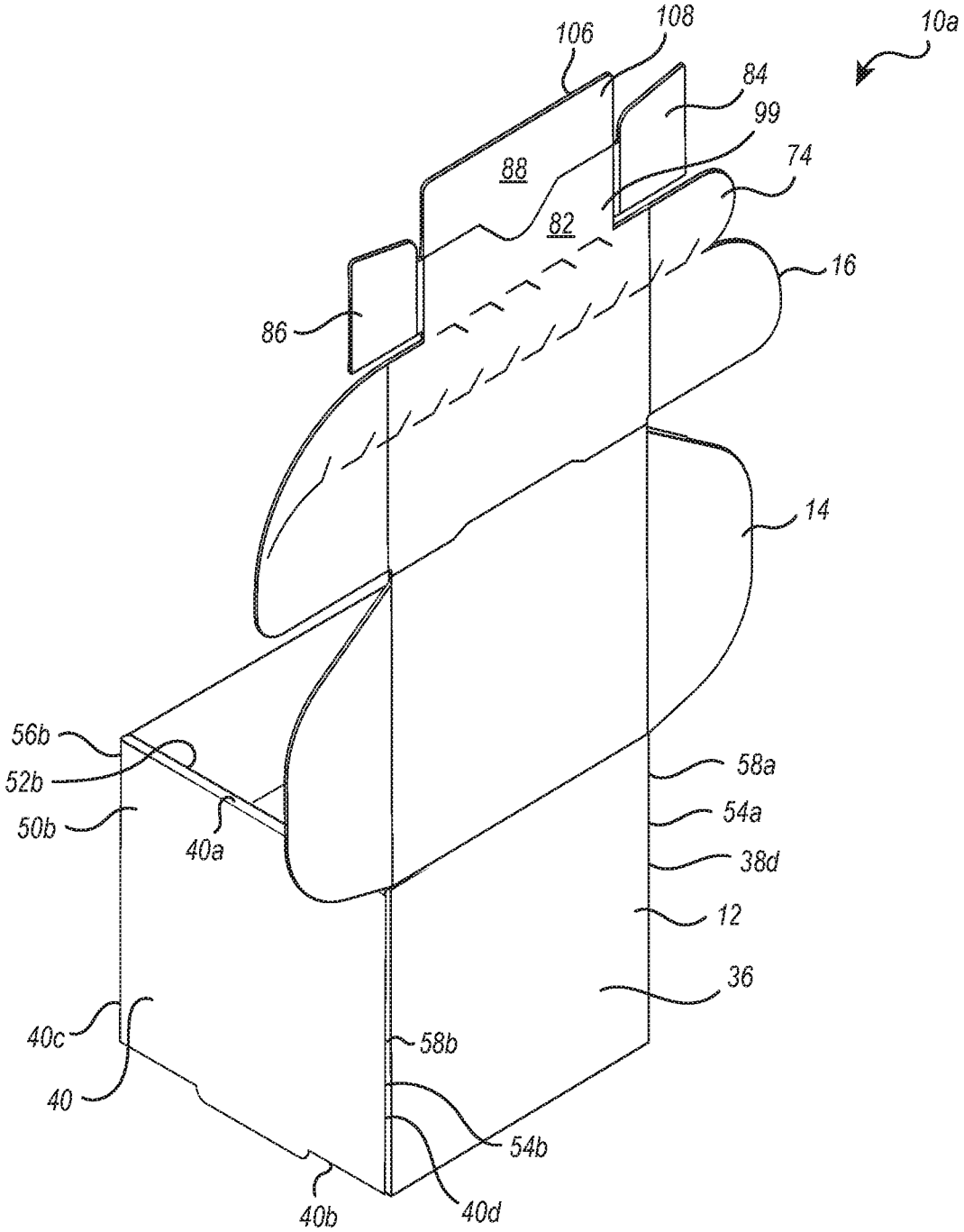
FIG. 2 is a rear perspective view of a zipper carton shown in FIG. 1.

Depicted in FIGS. 1 and 2 is one embodiment of an erected zipper carton 10*a* incorporating features of the present disclosure. In general, zipper carton 10*a* comprises a carton body 12, a cover panel assembly 14 projecting from carton body 12, and a locking panel assembly 16 projecting from cover panel assembly 14. Carton body 12 of zipper carton 10*a* generally includes an encircling sidewall 18 and a floor 20. Encircling sidewall 18 has an interior surface 22 that at least partially bounds compartment 24, an exterior surface 26 opposite interior surface 22, an upper end 28 that bounds an access opening 30 to compartment 24, and an opposing lower end 32 connected to floor 20. Encircling sidewall 18 comprises a front panel 34 and an opposing rear panel 36 that both extend between a first side panel 38 and an opposing second side panel 40. Each of panels 34, 36, 38, and 40 have an upper edge 34*a*, 36*a*, 38*a*, and 40*a*, respectively, at upper end 28 of sidewall 18 and a lower edge 34*b*, 36*b*, 38*b*, and 40*b*, respectively, at lower end 32 of sidewall 18.

An elongated slot 41 extends through front panel 34 and communicates with compartment 24. As discussed below in greater detail, slot 41 is used to lock zipper carton 10*a* in a closed position. Slot 41 has a length $L_1$ that extends between a first end 42 and an opposing second end 44. Slot 41 also has a width extending along the length L1. The width typically has a maximum or average dimension that is less than 4 mm and more commonly less than 3.5 mm or 3 mm. Other dimensions can also be used. In the depicted embodiment, a tab 46 centrally projects into slot 41 so that slot 41 is wider at opposing ends 42 and 44 and narrower in the middle. The function of tab 46 will be discussed below in greater detail. In alternative embodiments, tab 46 can be eliminated and the width of slot 41 can be constant. Slot 41 is typically oriented so as to be disposed parallel to top edge 34*a* and/or bottom edge 34*b*.

In the embodiment depicted, first side panel 38 is comprised of an exterior side panel 50*a* and an opposing interior side panel 52*a*. Panels 50*a* and 52*a* extend between upper edge 38*a* and lower edge 38*b* and also between a front edge 38*c* and an opposing back edge 38*d*. Panels 50*a* and 52*a* are connected together at upper edge 38*a* and bound a pocket 54*a* therebetween. A front opening 56*a* to pocket 54*a* is formed along front edge 38*c* while a back opening 58*a* to pocket 54*a* is formed along back edge 38*d*. As will be discussed below in more detail, a notch 59 is recessed into front edge 38*c* of exterior side panel 50*a* and extends back toward back edge 38*d*. Notch 59 also laterally passes through exterior side panel 50*a*.

Similarly, second side panel 40 is comprised of an exterior side panel 50*b* and an opposing interior side panel 52*b*. Panels 50*b* and 52*b* extend between upper edge 40*a* and lower edge 40*b* and also between a front edge 40*c* and an opposing back edge 40*d*. Panels 50*b* and 52*b* are connected together at upper edge 40*a* and bound a pocket 54*b* therebetween. A front opening 56*b* to pocket 54*b* is formed along front edge 40*c* while a back opening 58*b* to pocket 54*b* is formed along back edge 40*d*.

As will be discussed below in greater detail, a product retainer 60 can be disposed within compartment 24 for use in supporting a drug product or trial product therein.

As also shown in FIGS. 1 and 2, cover panel assembly 14 comprises a cover panel 64 having a front edge 64*a* and an opposing back edge 64*b* that extend between opposing side edges 64*c* and 64*d*. Back edge 64*b* connects to upper edge 36*a* of rear panel 36 while dust flaps 66 and 68 outwardly project from side edges 64*c* and 64*d*, respectively. Dust flaps 66 and 68 are optional and can be eliminated if desired. However, dust flaps 66 and 68 can be beneficial in that they function as shields to help prevent visual inspection of a trial product disposed within compartment 24 when zipper carton 10*a* is closed.

It is noted that between adjacent elements of zipper carton 10*a* where one element is designed to be folded relative to the other, such as between adjacent panels or between a panel and an adjacent tab or flap, a crease is formed in the sheet material used to form zipper carton 10*a* so as to enable easy, smooth and straight folding between the elements. The crease is typically formed by compression, such as by pressing a platen or die against the sheet material so that the sheet material at the crease is more compressed and thinner than the adjacent material. A score line can also be used to form a crease. For example, a crease 62*b* is formed at the intersection between cover panel 64 and rear panel 36 while creases 62*c* and 62*d* are formed at the intersection between cover panel 64 and dust flaps 66 and 68, respectively.

Cover panel 64 is sized and configured to cover access opening 30 of compartment 24. More specifically, when moving zipper carton 10*a* from an open position, as shown in FIG. 1, to a closed position, dust flaps 66 and 68 are folded inward along creases 66*c* and 66*d*, respectively. Cover panel 64 is then folded forward along crease 66*b* so as to cover access opening 30 while dust flaps 66 and 68 are received within compartment 24, as shown in FIG. 3.

Figure 3:
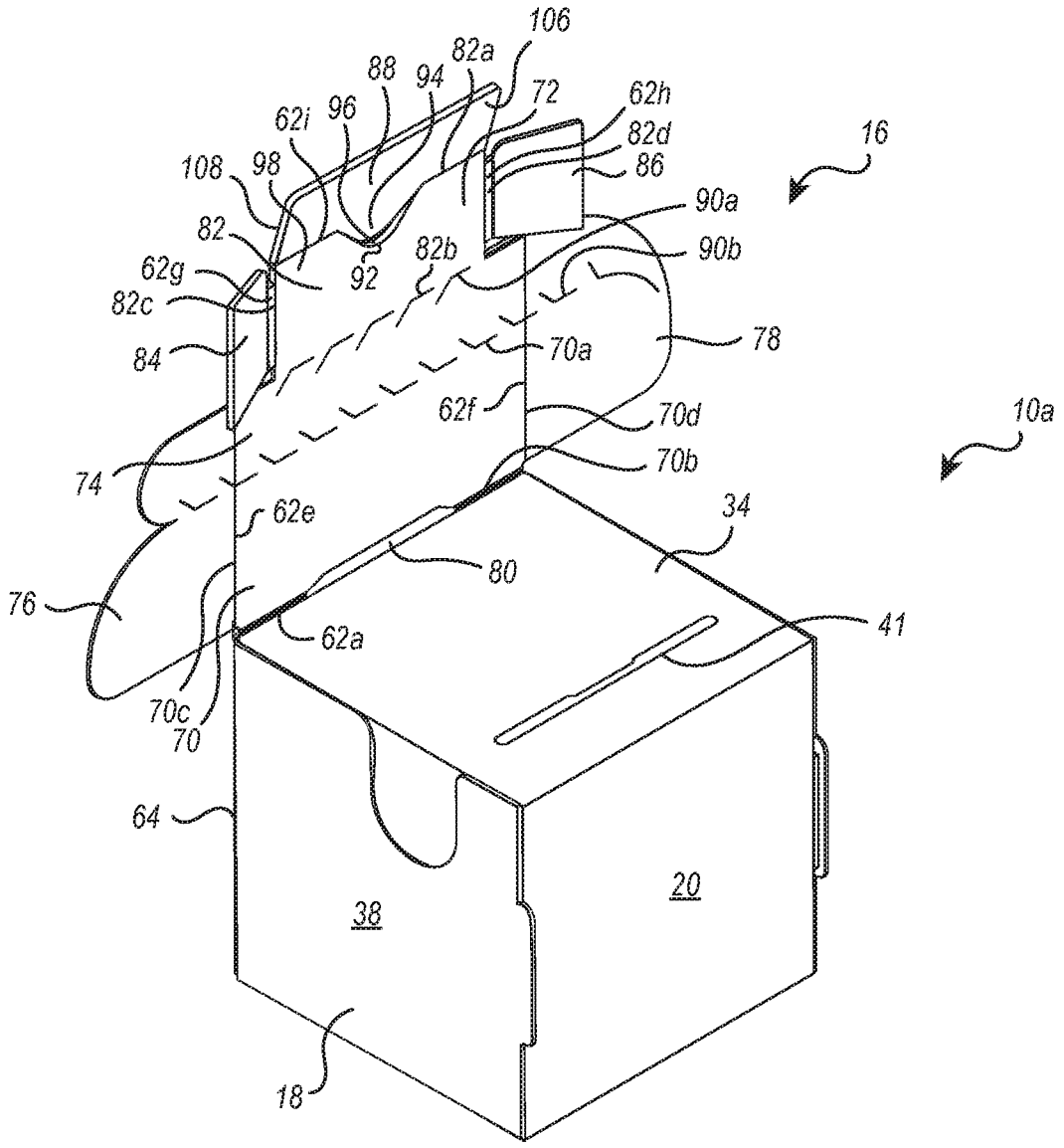
FIG. 3 is a perspective view of the zipper carton shown in FIG. 1 in a partially closed position.

As shown in FIG. 3, locking panel assembly 16 comprises an extension panel 70, a locking tab 72 and zipper tear strip 74 disposed therebetween. Extension panel 70 has a front edge 70*a*, a back edge 70*b* and opposing side edges 70*c* and 70*d*. Back edge 70*b* connects to front edge 64*a* of cover panel 64 and a crease 66*a* is formed thereat. As discussed below in greater detail, a secondary slot 80 centrally extends through crease 66*a*. As desired, secondary slot 80 can be adjusted up or down so as to extend either through extension panel 70 or through cover panel 64. Tuck flaps 76 and 78 outwardly project from side edges 70*c* and 70*d* of extension panel 70, respectively. Creases 62*e* and 62*f* are formed along side edges 70*c* and 70*d*, respectively.

Locking tab 72 comprises a base 82 having a front edge 82*a* and an opposing back edge 82*b* that extend between opposing side edges 82*c* and 82*d*. Back edge 82*b* connects to zipper tear strip 74. Base 82 also has a front face 98 and an opposing back face 99 (FIG. 3). A first retention flap 84 outwardly projects from side edge 82*c* with a crease 62*g* formed thereat. A second retention flap 86 outwardly projects from side edge 82*d* with a crease 62*h* formed thereat. For ease in folding and rebounding, as discussed below, retention flaps 84 and 86 are typically spaced apart from zipper tear strip 74 and do not directly connect to zipper tear strip 74. Rather, retention flaps 84 and 86 only indirectly connect to zipper tear strip 74 through base 82. As better seen in FIG. 1, base 82 has a linear length $L_2$ extending between opposing side edges 82*c* and 82*d* that is equal to or smaller than length $L_1$ of slot 41. Locking tab 72 has a linear length $L_3$ extending between an outside edge 84*a* of first retention flap 84 and an outside edge 86*a* of second retention flap 86 that is longer than length $L_1$ of slot 41.

Returning to FIG. 3, a third retention flap 88 projects from front edge 82A of base 82 with a crease 62*i* formed thereat. Retention flap 88 has a front face 106 and an opposing back face 108 (FIG. 2). Front edge 82*a* is linear at opposing ends but includes a centrally disposed notch 92 having a rounded V-shaped configuration. Third retention flap 88 has a central projection 94 that projects into notch 92 and that has a complementary rounded v-shaped configuration. A cut slit 96 is formed at the intersection between notch 92 and projection 94 so that projection 94 can freely pivot within notch 92 when retention flap 88 is folded relative to base 82. Cut slit 96 facilitates easy folding of third retention flap 88 relative to base 82 and helps to limit resilient rebounding of third retention flap 88, as discussed below in greater detail. However, in alternative embodiment, notch 92, projection 94 and cut slit 96 can be eliminated and a single, linear crease 62*i* can extend along the entire intersection between retention flap 88 and base 82. Third retention flap 88 extends along the length of base 82 and typically has a length that is equal to the length of base 82 or is at least 90%, 80% or 70% of the length of base 82. As better seen in FIG. 1, retention flaps 84 and 86 each have a top edge 84*b* and 86*b*, respectively, that projects above crease 62*i*. As such, top edges 84*b* and 86*b* are horizontally aligned with retention flap 88. As discussed below in greater detail, this configuration makes it easier for retention flap 88 to block inward folding of retention flaps 84 and 86 when retention flap 88 is folded forward toward base 82.

Figure 7:
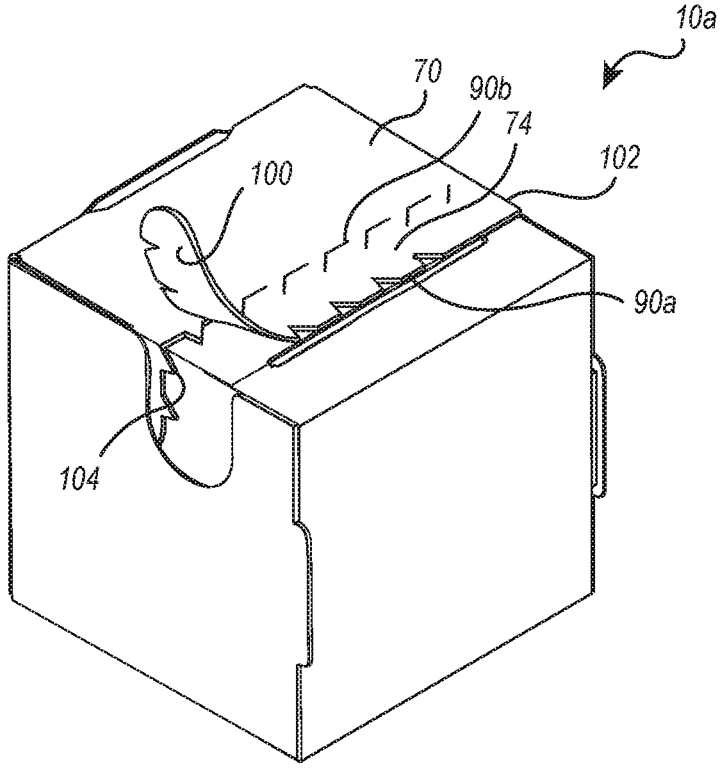
FIG. 7 is a perspective view of the zipper carton shown in FIG. 5 with the zipper tear strip being partially removed.

Returning to FIG. 3, zipper tear strip 74 is disposed between and connects to locking tab 72 and extension panel 70. Zipper tear strip 74 is formed so as to be removable by producing a first row of spaced apart perforation 90*a* at the intersection between zipper tear strip 74 and locking tab 72 and a second row of spaced apart perforations 90*b* at the intersection between zipper tear strip 74 and extension panel 70. Where zipper tear strip 74 connects with tuck flaps 67 and 78, second row of perforations 90*b* can also extend along the intersection between zipper tear strip 74 and tuck flaps 67 and 78. In the embodiment depicted, the perforations have a substantially V-shaped configuration with one leg linearly extending along the length of the corresponding row 90*a* or 90*b* and the other leg sloping to the center between rows 90*a* and 90*b*. In other embodiments, the perforations can have different configurations. The perforations are linearly spaced apart and typically extend completely through locking panel assembly 16. With reference to FIG. 7, by outwardly pulling on a first end 100 of zipper tear strip 74 toward an opposing second end 102 thereof, the small sections of locking panel assembly 16 disposed between adjacent perforations are torn through, thereby enabling zipper tear strip 74 to be removed from locking tab 72 and extension panel 70.

By use of locking panel assembly 16, zipper carton 10*a* can be selectively and manually moved between an open position, a closed position, and a closed, locked position. In the open position, as shown in FIG. 1, compartment 24 can be freely accessed through access opening 30 which is uncovered.

To move zipper carton 10*a* to the closed position or the closed/locked position, dust flaps 66 and 68 are folded inward along creases 62*c* and 62*d*, respectively. As previously discussed, cover panel 64 is then folded forward along crease 62*b* to cover access opening 30 while dust flaps 66 and 68 are received within compartment 24, as shown in FIG. 3.

Figure 4:
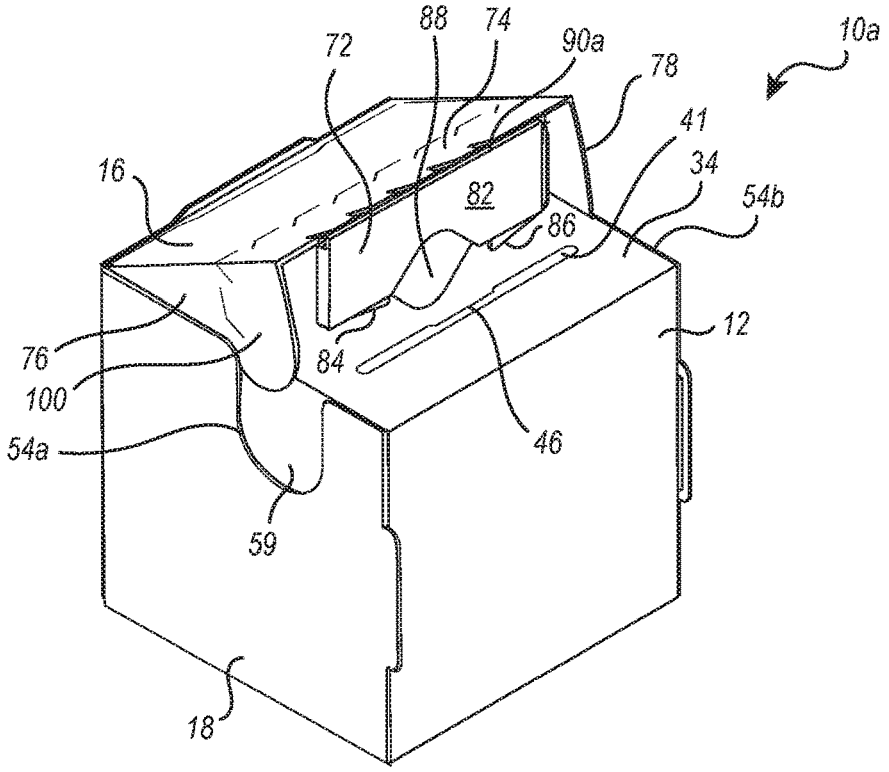
FIG. 4 is a perspective view of the zipper carton shown in FIG. 3 with a locking panel assembly thereof being moved toward a closed and locked position.
Figure 5:
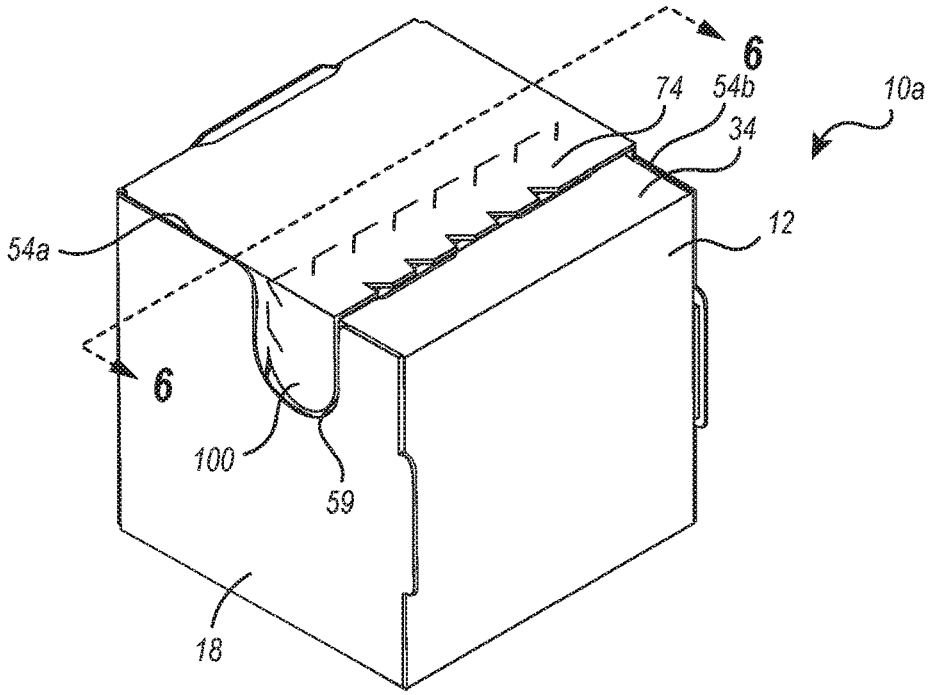
FIG. 5 is a perspective view of the zipper carton shown in FIG. 4 in a fully closed and locked position.

Next, tuck flaps 76 and 78 of locking panel assembly 16 are inwardly folded along creases 62*e* and 62*f*, respectively, so that tuck flaps 76 and 78 are generally perpendicular to extension panel 70. Locking panel assembly 16 is then folded forward along crease 62*a* so that tuck flaps 76 and 78 are received within pockets 54*a* and 54*b*, respectively, as shown in FIG. 4. Notch 59 is configured so that when tuck flaps 76 and 78 are received within pockets 54, first end 100 of zipper tear strip 74, which extends along tuck flap 76, is received within notch 59, as shown in FIG. 5. This configuration leaves first end 100 of zipper tear strip 74 openly exposed so that it can be easily grasped for removal of zipper tear strip 74, as discussed above.

Inserting tuck flaps 76 and 78 within pockets 54 holds zipper carton 10*a* in a closed position where access opening 30 is covered. However, zipper carton 10*a* can be moved back to the open position by simply reversing the above steps.

To move zipper carton 10*a* to the closed and locked position, locking tab 72, as shown in FIG. 4, is folded into a collapsed position, either prior to or after the folding of tuck flaps 76 and 78. In one method, folding locking tab 72 into a collapsed position requires manually folding each of retention flaps 84, 86, and 88 from a relaxed position to a folded position. Retention flaps 84, 86, and 88 are shown in FIGS. 1 and 2 in a relaxed position, i.e., retention flaps 84, 86 and 88 are not subject to a stress or force that warrants immediate movement relative to base 82. Commonly, when in the relaxed position, each of retention flaps 84, 86, and 88 is disposed in a common plane with base 82, as shown in FIG. 1. However, each of retention flaps 84, 86, and 88 can be bent slightly relative to each other and/or relative to base 82 and still remain in a relaxed position.

When moved to a folded position, each of retention flaps 84, 86, and 88 is manually folded relative to base 82 so that if manually released, retention flaps 84, 86, and 88 automatically resiliently rebound back toward the relaxed position, i.e., rebound to a rebound position. This resilient rebounding of retention flaps 84, 86, and 88 is a result of the properties of the material used to make zipper carton 10*a* and, more specifically, locking panel assembly 16. As will be discussed below in more detail, zipper carton 10*a* is formed from a flexible sheet of material having properties that enables resilient rebounding of retention flaps 84, 86, and 88 as discussed herein.

In one method of collapsing locking tab 72, retention flaps 84, 86, and 88 are moved from the relaxed position to the folded position by first folding third retention flap 88 so as to be disposed against or adjacent to front face 98 (FIG. 3) of base 82. Retention flaps 84 and 86 are then inwardly folded so as to be disposed against or adjacent to back face 108 (FIG. 2) of third retention flap 88. In each of these steps, retention flaps 84, 86, and 88 are typically folded over an angle of at least 140°, 150°, 160°, 170°, or 180° or in a range between any two of the foregoing angles. Either before or after collapsing locking tab 72, locking tab 72 is folded forward along first row of perforation 90*a* so as to be substantially perpendicular to zipper tear strip 74, as depicted in FIG. 4.

Figure 6:
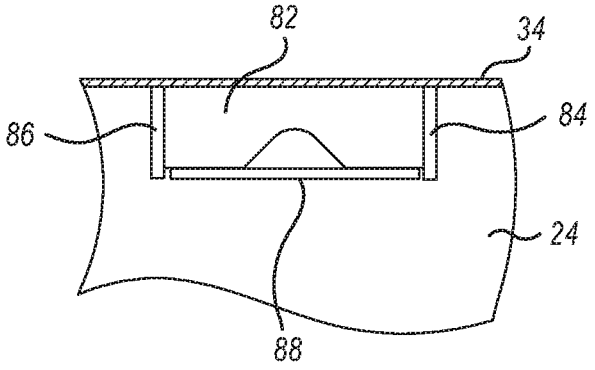
FIG. 6 is a cross-sectional side view of the locking tab of the zipper carton shown in FIG. 5 taken along line 6-6.

Finally, while manually holding locking tab 72 in the collapsed position, locking panel assembly 16 is folded flush against front panel 34 of carton body 12/encircling sidewall 18 while collapsed locking tab 72 is slid or passed through slot 41 and into compartment 24. As collapsed locking tab 72 is advanced into slot 41, retention flaps 84, 86, and 88 are released allowing them to automatically rebound within compartment 24 behind front panel 34 to the rebound position, i.e., back toward the relaxed position. The extent that retention flaps 84, 86, and 88 rebound back toward the relaxed position is primarily dependent upon the material used to make locking panel assembly 16. However, retention flaps 84, 86, and 88 will typically rebound at least 30°, 50°, 70° or 90°. Because retention flaps 84, 86, and 88 rebound away from base 82, retention flaps 84, 86, and 88 block and prevent locking tab 72 from being pulled out of slot 41. For example, as depicted in FIG. 6, retention flaps 84, 86 and 88 have each rebounded so as to project orthogonal to base 82. Retention flaps 84 and 86 thus also extend orthogonal to slot 41 (FIG. 4) which prevents locking tab 72 from sliding out of slot 41.

With reference to FIG. 4, as previously mentioned, a tab 46 centrally projects into slot 41. Tab 46 is configured to fit between folded retention flaps 84 and 86 as collapsed locking tab 72 is passed into slot 41. The use of tab 46 thus helps to minimize the area or open space of slot 41 which in turn helps prevent removal of locking tab 72 from slot 41, helps limit any visual inspection of the trial product through slot 41, and helps prevent the insertion of any tool or instrument within slot 41 that could be used to try to withdraw locking tab 72 from slot 41. In other embodiments, however, tab 46 can be eliminated.

Folding third retention flap 88 first against base 82 and then folding retention flaps 84 and 86 on top of retention flap 88 has multiple advantages. First, in this configuration, the rebounding of retention flap 88 assists in the rebounding of retention flaps 84 and 86. Furthermore, by retention flap 88 rebounding to the extent shown in FIG. 6, retention flap 88 remains disposed between retention flaps 84 and 86. This helps to preclude the inward folding of retention flaps 84 and 86 back toward base 82 that could potentially permit the withdrawal of locking tab 72 from slot 41. For example, a person could potentially insert a thin tool or instrument, such as a pin or extended paper clip, into the opposing ends of slot 41 to try to press retention flaps 84 and 86 back to the folded position. However, in the present configuration, even if a thin tool or instrument could be positioned against retention flaps 84 and 86 within compartment 24, retention flap 88 prevents the folding of retention flaps 84 and 86 back to the folded position, thereby further preventing any removal of locking tab 72 from slot 41.

With retention flaps 84, 86, and 88 in the rebounded position, zipper carton 10*a* is in a closed and locked position. That is, access opening 30 is covered and zipper carton 10*a* cannot be moved back to the open position, where access opening 30 is uncovered, without cutting, tearing or other destruction of a portion of zipper carton 10*a*. For example, manually pulling locking tab 72 out of slot 41 would result in tearing retention flaps 84 and 86 fully, or at least partially, from base 82. Such tearing would provide visual indication that zipper carton 10*a* has been opened and would preclude the reclosing and locking of zipper carton 10*a*. It is also noted that when zipper carton 10*a* is in the closed and locked position that all of the opposing walls are tightly held together in a close tolerance so that any drug product or trial product disposed within compartment 24 can typically not be seen and/or cannot be removed from compartment 24 without some visual destruction of zipper carton 10*a*.

When it is desired to open zipper carton 10*a*, as shown in FIG. 7, first end 100 of zipper tear strip 74 is grasped and is pulled toward opposing second end 102. In so doing, zipper carton 10*a* is torn along rows 90*a* or 90*b* of perforations so as to remove zipper tear strip 74 and thereby separate locking tab 72 from extension panel 70. Extension panel 70 and cover panel assembly 14 can then be unfolded back to the open position, as shown in FIG. 8, so as to again provide free access to compartment 24, and any drug product or trial product therein, through access opening 30. However, the removal of zipper tear strip 74 (FIG. 7) leaves a jagged edge 104 along where row 90*b* of perforation existed, thereby providing a clear visual indication that zipper carton 10*a* has been opened. Furthermore, with the removal of zipper tear strip 74, zipper carton 10*a* cannot be moved back to the closed, locked position.

Figure 9:
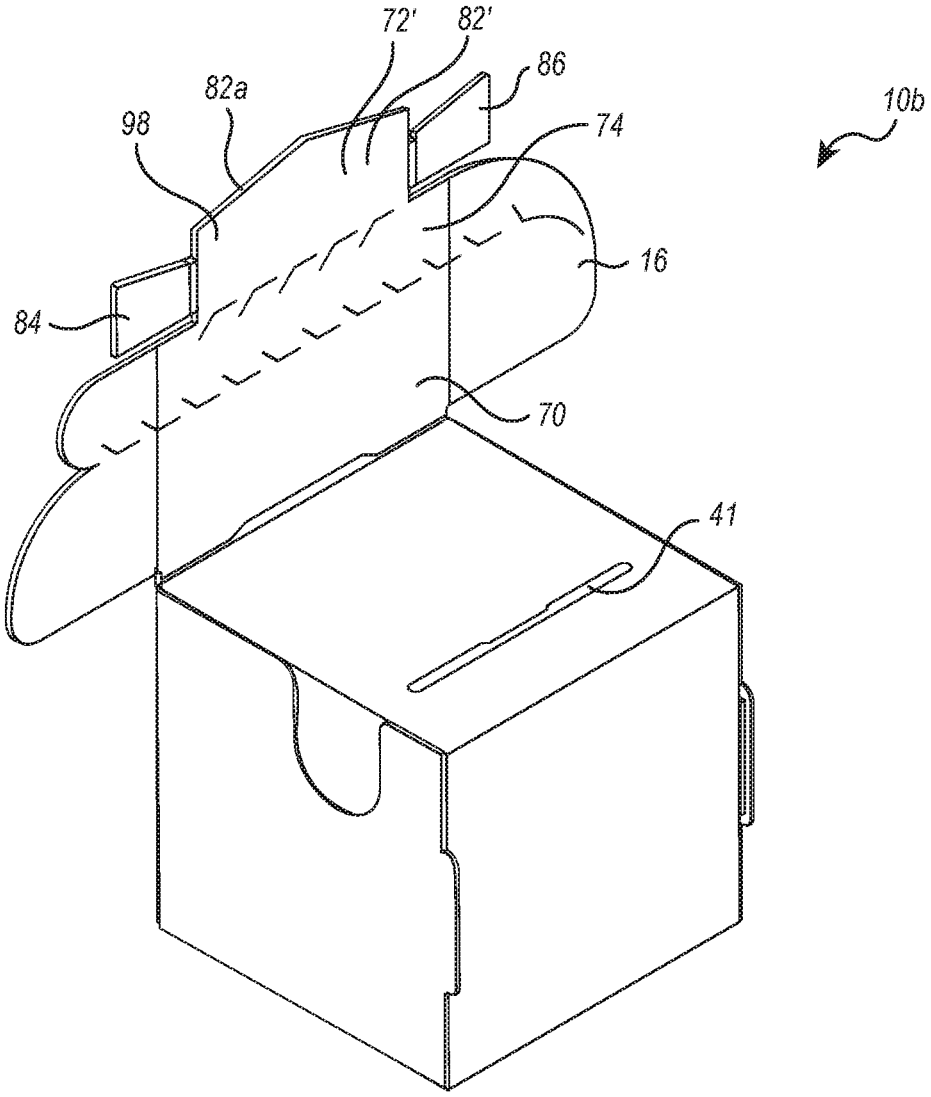
FIG. 9 is a perspective view of an alternative embodiment of a zipper carton with a modified locking tab.

The above discussion of zipper carton 10*a* is one configuration and one method of use. It is appreciated, however, that zipper carton 10*a* can be used in a variety of different ways and can have a variety of different configurations. For example, depicted in FIG. 9 is a second embodiment of a zipper carton 10*b*. Like elements between zipper cartons 10*a* and 10*b* are identified by like reference characters. Zipper carton 10*b* is identical to zipper carton 10*a* except that zipper carton 10*b* includes a locking tab 72'. In locking tab 72', third retention flap 88 has been deleted and base 82 has been replaced with a base 82'. Base 82' includes a front edge 82*a* that outwardly tapers in a V-shape configuration for ease in aligning and inserting within slot 41.

Figure 10:
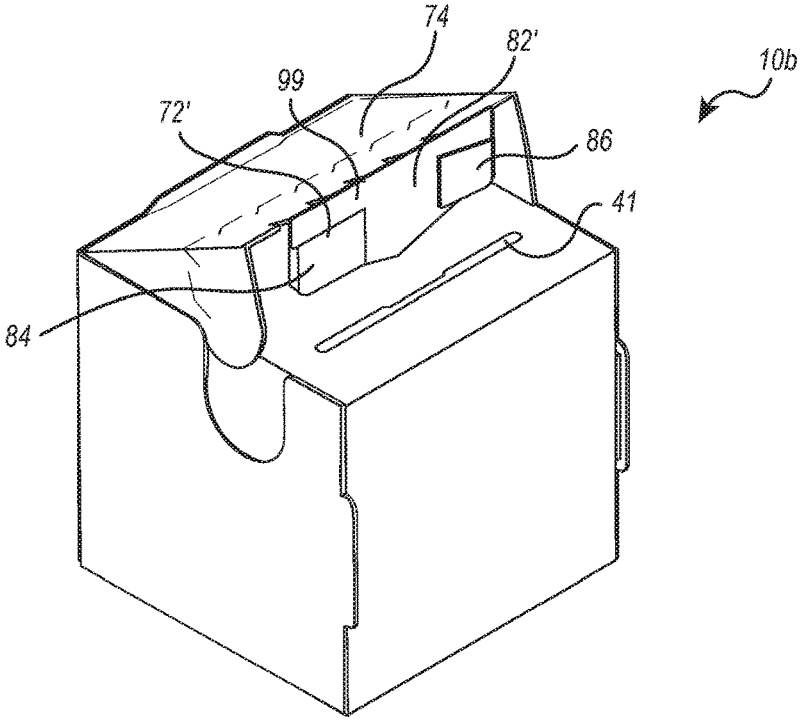
FIG. 10 is a perspective view of the zipper carton shown in FIG. 9 being moved towards a closed and locked position.

Zipper carton 10*b* can be moved between an open position, similar to that shown in FIG. 1, where compartment 24 can be accessed through access opening 30, and a closed, lock position. When moving to the closed, locked position, retention flaps 84 and 86 are folded from a relax position, as shown in FIG. 9, to a fold position. For example, retention flaps 84 and 86 can be folded against or adjacent to front face 98 (FIG. 9) of base 82' or, as shown in FIG. 10, can be folded against or adjacent to back face 99 of base 82'. Folding retention flaps 84 and 86 toward front face 98 enables them to be covered by zipper tear strip 74 and extension panel 70, thereby helping to prevent unwanted access to retention flaps 84 and 86. However, it can be easier to fold and hold retention flaps 84 and 86 against back face 99 when inserting locking tab 72' into slot 41. In other embodiments, retention flaps 84 and 86 can be folded in opposite directions, e.g., one toward front face 98, the other toward back face 99.

When locking tab 72' is in the collapsed position, locking tab 72' is slide within slot 41. Retention flaps 84 and 86 then automatically rebound to a rebound position so as to prevent locking tab 72' from being pulled out of slot 41, thereby securing zipper carton 10*b* in the closed and locked position. When desired, zipper carton 10*b* can be moved to an open position by removal of zipper tear strip 74, as previously discussed.

Figure 11:
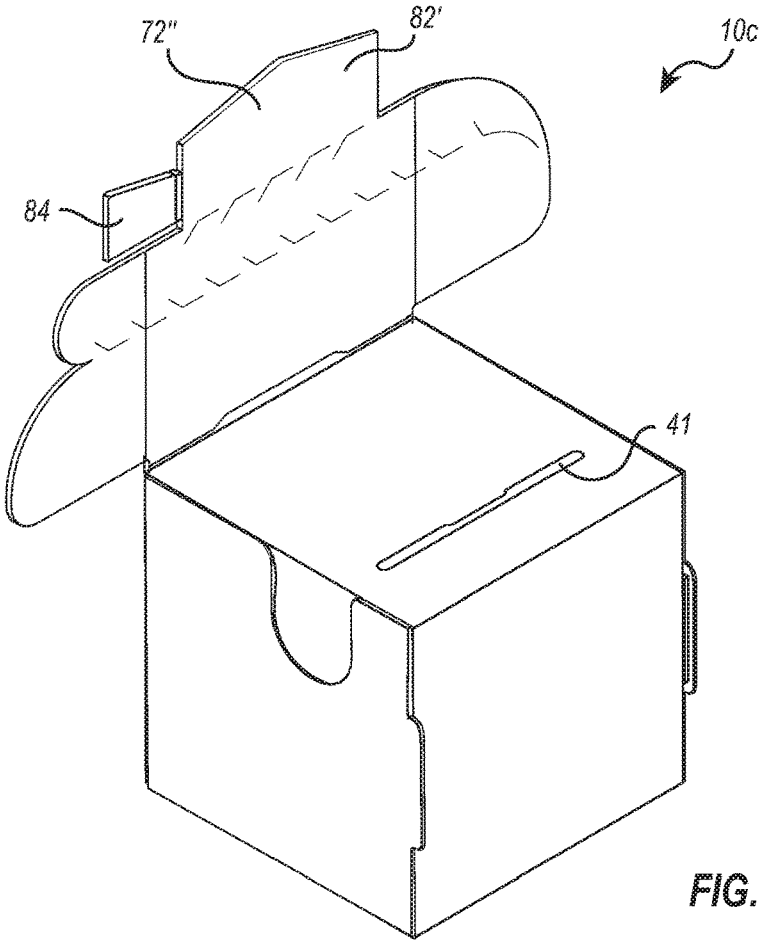
FIG. 11 is a perspective view of an alternative embodiment of a zipper carton having a further modified locking tab.
Figure 12:
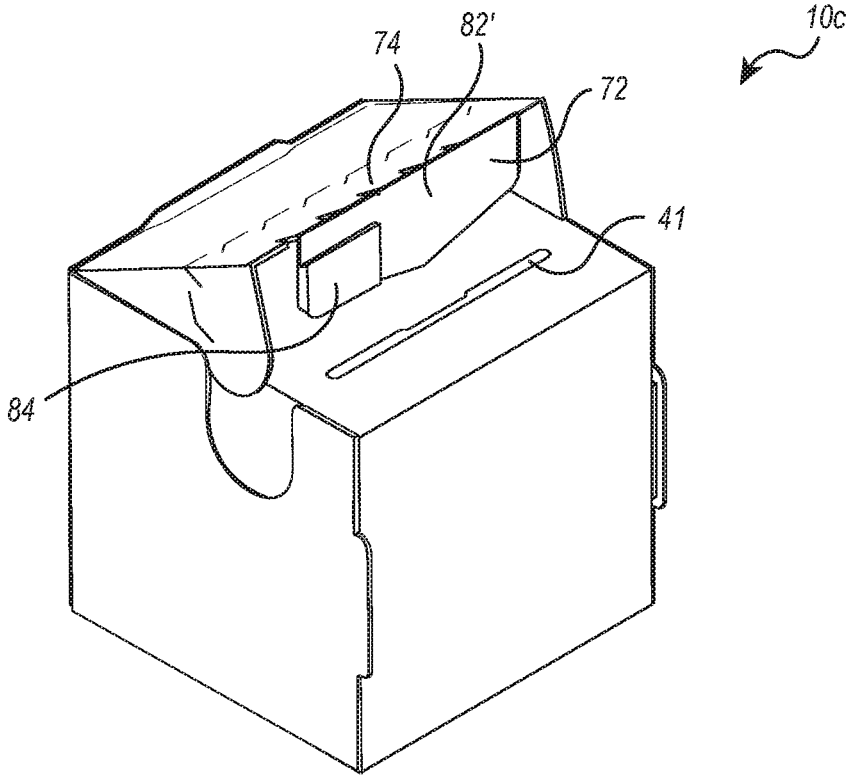
FIG. 12 is a perspective view of the zipper carton shown in FIG. 11 being moved towards a closed and locked position.

FIG. 11 depicts another alternative embodiment of a zipper carton 10*c*. Zipper carton 10*c* is identical to zipper carton 10*b* except that zipper carton 10*c* includes a locking tab 72" where retention flap 86 has been removed. As such, locking tab 72" includes base 82' and a single retention flap 84 projecting therefrom. Zipper carton 10*c* can be moved between an open position, similar to that shown in FIG. 1, where compartment 24 can be accessed through access opening 30, and a closed, locked position. When moving to the closed, locked position, retention flap 84 is moved from the relaxed position, as shown in FIG. 11, to a folded position, as shown in FIG. 12. In the folded position, retention flap 84 can be folded against or adjacent to either front face 98 or back face 99 of base 82'. Collapsed locking tab 72" can then be advanced into slot 41 following which retention flap 84 automatically rebounds to the rebound position, thereby locking locking tab 72" within slot 41. Again, zipper carton 10*c* can be selectively opened by removal of zipper tear strip 74, as previously discussed.

Figure 13:
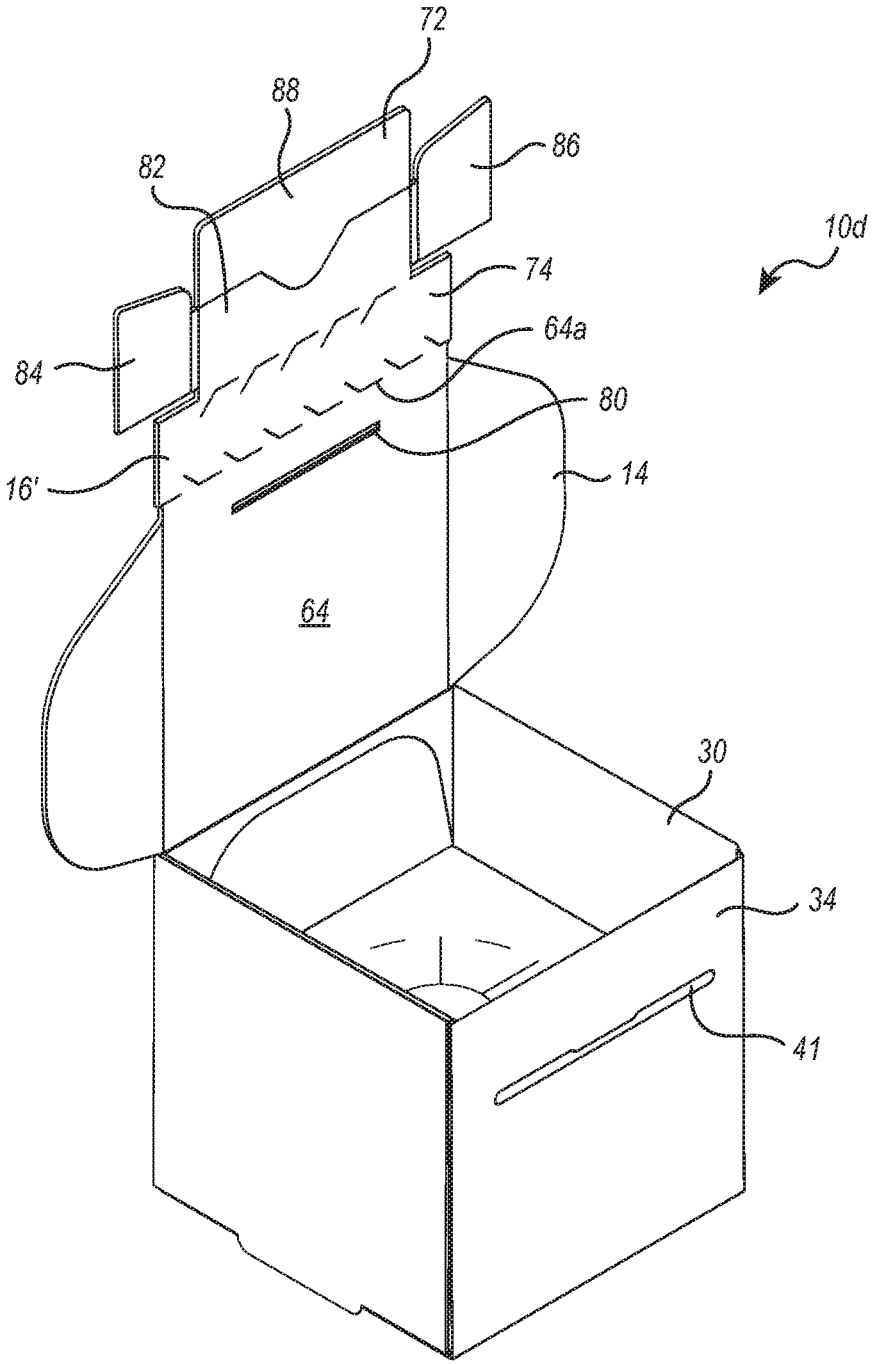
FIG. 13 is a perspective view of a further alternative embodiment of a zipper carton having a modified locking panel assembly.

Depicted in FIG. 13 is another alternative embodiment of a zipper carton 10*d*. Like elements between zipper carton 10*a* and 10*d* are identified by like reference characters. Zipper carton 10*d* is sustainably identical to zipper carton 10*a* except that locking panel assembly 16 has been replaced with a locking panel assembly 16'. In locking panel assembly 16', extension panel 70 and tuck flaps 76 and 78 (FIG. 1) have been removed. As such, front edge 64A of cover panel 64 connects directly to zipper tear strip 74. In this embodiment, cover panel 64 still functions the same way, as previously discussed, to cover access opening 30 while locking tab 72 still functions the same way, as previously discussed, to lock within slot 41. However, with the removal of extension panel 70, slot 41 has been moved upward on front panel 34 so that it can be reached by locking tab 72 while secondary slot 80 can be moved down onto cover panel 64. Furthermore, locking panel assembly 16' now folds at front edge 64A as it folds over and onto front panel 34.

Zipper tear strip 74 has also been shortened in zipper carton 10*d* so as to only extend along the length of front edge 64A of cover panel 64. As such, notch 59 (FIG. 1) has been eliminated. After zipper carton 10*d* has been moved to the closed, locked position, zipper carton 10*d* can again be moved to the open position by the removal of zipper tear strip 74, as previously discussed.

Figure 14:
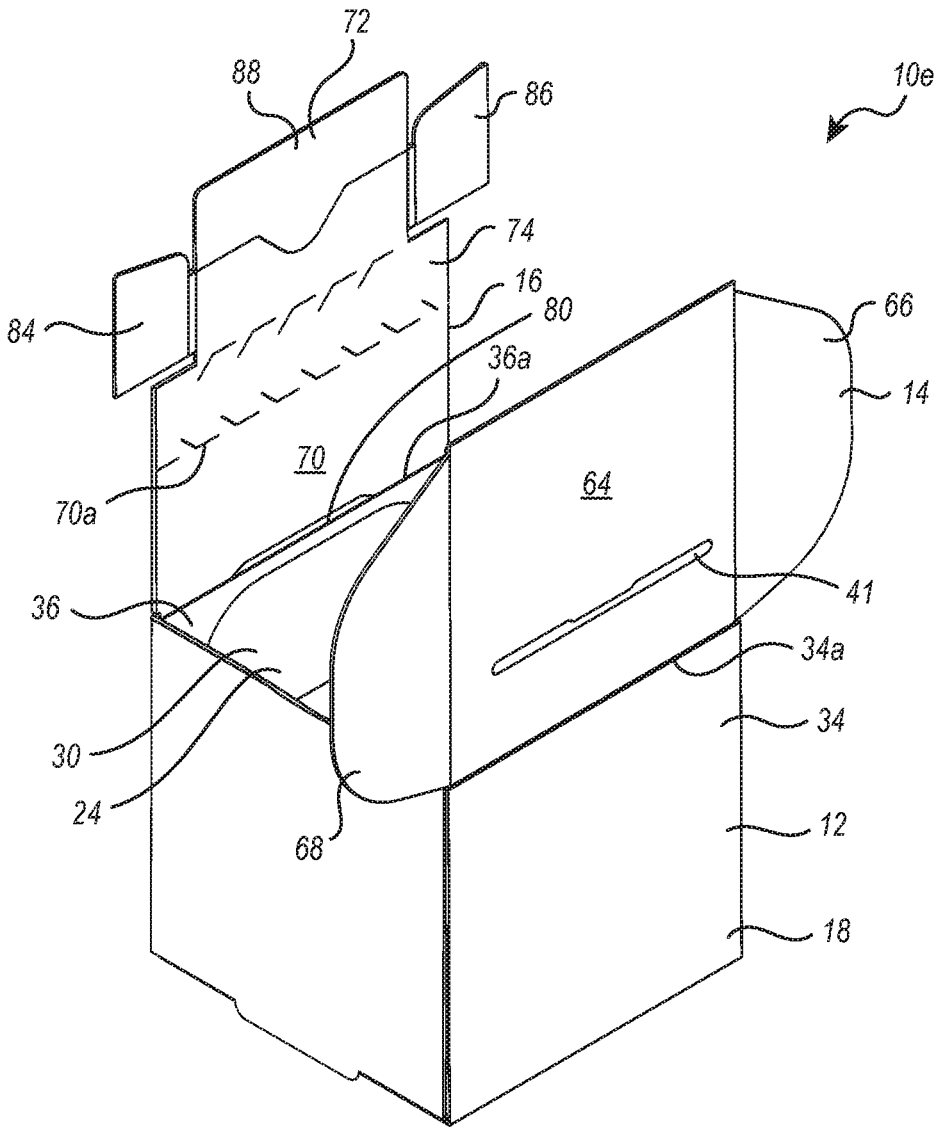
FIG. 14 is a perspective view of a further alternative embodiment of a zipper carton having modified cover panel assembly and a modified locking panel assembly.

Turning to FIG. 14 is another alternative embodiment of a zipper carton 10*e*. Like elements between zipper carton 10*a* and 10*e* are identified by like reference characters. As with zipper carton 10*a*, zipper carton 10*e* includes carton body 12 having encircling sidewall 18. However, in contrast to having cover panel assembly 14 projecting from rear panel 36 and locking panel assembly 16 projecting from cover panel assembly 14, zipper carton 10*e* has cover panel assembly 14 projecting from upper edge 34*a* of front panel 34 and locking panel assembly 16 projecting from upper edge 36*a* of rear panel 36. Locking panel assembly 16 has also been modified to remove tuck flaps 76 and 78 and to shorten zipper tear strip 74 to extend only along the front edge 70*a* of extension panel 70.

FIG. 14 shows zipper carton 10*e* in an open position where compartment 24 can be freely accessed through access opening 30. To move zipper carton 10*e* to the closed, locked position, dust flaps 66 and 68 are inwardly folded and cover panel assembly 14 is folded forward along upper edge 34A so that dust flaps 66 and 68 are received within compartment 24 and cover panel 64 covers all or at least a portion of access opening 30. Locking tab 72 can then be moved to the clasped position and locking panel assembly 16 folded over cover panel 64 with collapsed locking tab 72 being received within slot 41. Retention flaps 84, 86, and 88, then automatically rebound to the rebound position, thereby locking locking tab 72 within compartment 24 behind cover panel 64. To access compartment 24, zipper tear strip 74 can be selectively removed, as previously discussed.

It is appreciated that different elements between zipper cartons 10*a*-10*e* can be freely mixed and matched. For example, locking tab 72 of zipper cartons 10*d* and 10*e* can be replaced with locking tab 72' or 72", of zipper cartons 10*b* and 10*c*.

Figure 15:
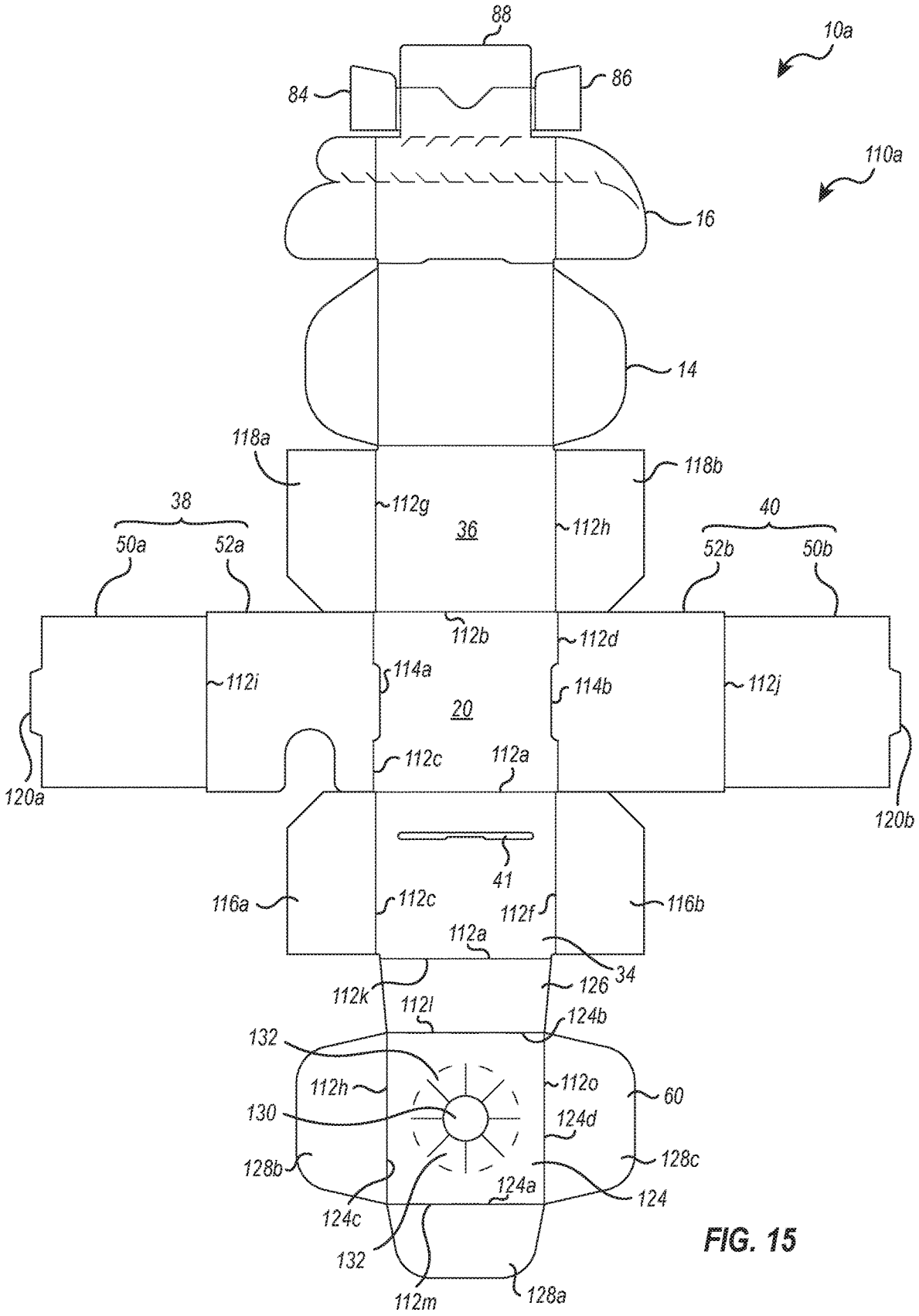
FIG. 15 is a top plan view of a flat template of the zipper carton shown in FIG. 1.

Zipper carton 10*a* and the alternative embodiments thereof can be formed in a variety of different ways and can be formed so that carton body 12 has a variety of different configurations. Depicted in FIG. 15 is a top plan view of zipper carton 10*a* in a flat disassembled configuration. More specifically, FIG. 15 shows a flat template 110*a* that has been cut, such as through a die press or otherwise formed, so that it can be folded and secured into erected zipper carton 10*a*, shown in FIGS. 1 and 2. Template 110*a* can be comprised of a foldable sheet of material that typically retains a crease when folded but does fail by tearing through when folded over an angle of at least 90° and more commonly at least 180° or 270°. The sheet of material also facilitates the automatic, resilient rebounding of retention flaps 84, 86, and 88 as the retention flaps are moved from the relaxed position to the folded position and then released, as previously discussed.

Template 110*a* typically comprises a single, continuous, unitary structure. That is, template 110*a* is typically cut or otherwise formed from one continuous sheet of material as opposed to being formed from two or more separate pieces of a sheet of material that are later connected together, such as by crimping, welding, mechanical connection, adhesive connection or the like. However, in other embodiments, template 110*a* can be formed from two or more pieces of a sheet of material that are connected by crimping, welding, mechanical connection, adhesive connection, or the like. This latter embodiment, however, is typically less efficient since it is more complicated to produce.

The sheet of material can comprise a paper-based material, such as paper, cardstock, paperboard or cardboard. In other embodiments, the sheet of material can be comprised of a synthetic, plastic, or other material (e.g., adapted to retain a crease when folded and produce the resilient rebounding discussed herein). The sheet of material can comprise a composite, a laminate, an extrusion, or a base sheet having a coating on one or both opposing sides thereof. Template 110*a*/sheet of material can have a thickness suitable for various embodiments of zipper carton 10*a*. For instance, template 110*a* typically has a thickness of at least 0.3 mm, 0.4 mm, 0.5 mm, 0.8 mm 1 mm, 1.2 mm, 1.5, 2 mm 2.5 mm or in a range between any two of the foregoing. The sheet of material selected to form template 110*a* and the zipper cartons discussed herein can be selected so that the various retention flaps discussed herein produced the discussed resilient rebounding. The extent of the resilient rebounding produced by a sheet can be a factor of thickness, density, stiffness and/or composition of the sheet/paper. Whether a sheet, such as a sheet of paper material, achieves the desired functional properties can be determined through empirical testing. In one embodiment, the templates and zipper cartons disclosed herein can be produced having desired functional properties by being formed from solid bleached board (SBB) or solid bleached sulphate (SBS) paperboard having a thickness in a range between 0.4 mm and 0.8 mm and more commonly between 0.5 mm and 0.7 mm. In one embodiment, the paperboard can have a mineral or synthetic pigment coating on one side or both opposing sides. In another alternative embodiment, the templates and zipper cartons disclosed herein can be produced having desired functional properties by being formed from an E-flute corrugated cardboard having a thickness in a range between 1 mm and 2 mm with between 1.3 mm and 1.7 mm being more common. Other materials can also be used.

Continuing with FIG. 15, template 110*a* comprises floor 20 with front panel 34, rear panel 36, first side panel 38 and second side panel 40 projecting therefrom. As previously discussed, where one element is designed to be folded relative to another, such as between adjacent panels or between a panel and an adjacent tab or flap, a crease is formed in the sheet material so as to enable easy, smooth, and straight folding between the elements. In the depicted embodiment, creases 112*a*, 112*b*, 112*c* and 112*d* are formed at the intersection with floor 20 and front panel 34, rear panel 36, first side panel 38 and second side panel 40, respectively. For reasons as will be discussed below in greater detail, cut slits 114*a* and 114*b* are centrally formed through creases 112*c* and 112*d*, respectively. Projecting from opposing sides front panel 34 are tuck flaps 116*a* and 116*b* with creases 112*e* and 112*f* formed therebetween, respectively. Similarly, tuck flaps 118*a* and 118*b* project from the opposing sides of back panel 36 with creases 112*e* and 112*f* formed therebetween, respectively.

First side panel 38 includes exterior side panel 50*a* and interior side panel 52*a* with a crease 112*i* formed therebetween. A tab 120*a* outwardly projects from the free end of exterior side panel 50*a* and is configured to be received within cut slit 114*a*. Similarly, second side panel 40 includes exterior side panel 50*b* and interior side panel 52*b* with a crease 112*j* formed therebetween. A tab 120*b* outwardly project from the free end of exterior side panel 50*b* and is configured to be received within cut slit 114*b*.

Template 110*a* also includes product retainer 60. Product retainer 60 includes a support panel 124 having a front edge 124*a*, an opposing back edge 124*b* and opposing side edges 124*c* and 124*d*. An extension panel 126 extends from back edge 126*b* to upper edge 34*a* of front panel 34. A crease 112*k* is formed at the intersection of extension panel 126 and front panel 34 while a crease 112*l* is formed at the intersection of extension panel 126 and support panel 124. Support flaps 128*a*, 128*b*, and 128*c* project from front edge 124*a*, side edge 124*c* and side edge 124*d* of support panel 124, respectively, while creases 112*m*, 112*n*, and 112*o* are formed at the intersections thereof, respectively. Support panel 124 has an opening 130 centrally extending therethrough and includes a plurality of flexible brace flaps 132 that encircle opening 130. Finally, cover panel assembly 14 and locking panel assembly 16 are connected to rear panel 36 as previously discussed.

Figure 16:
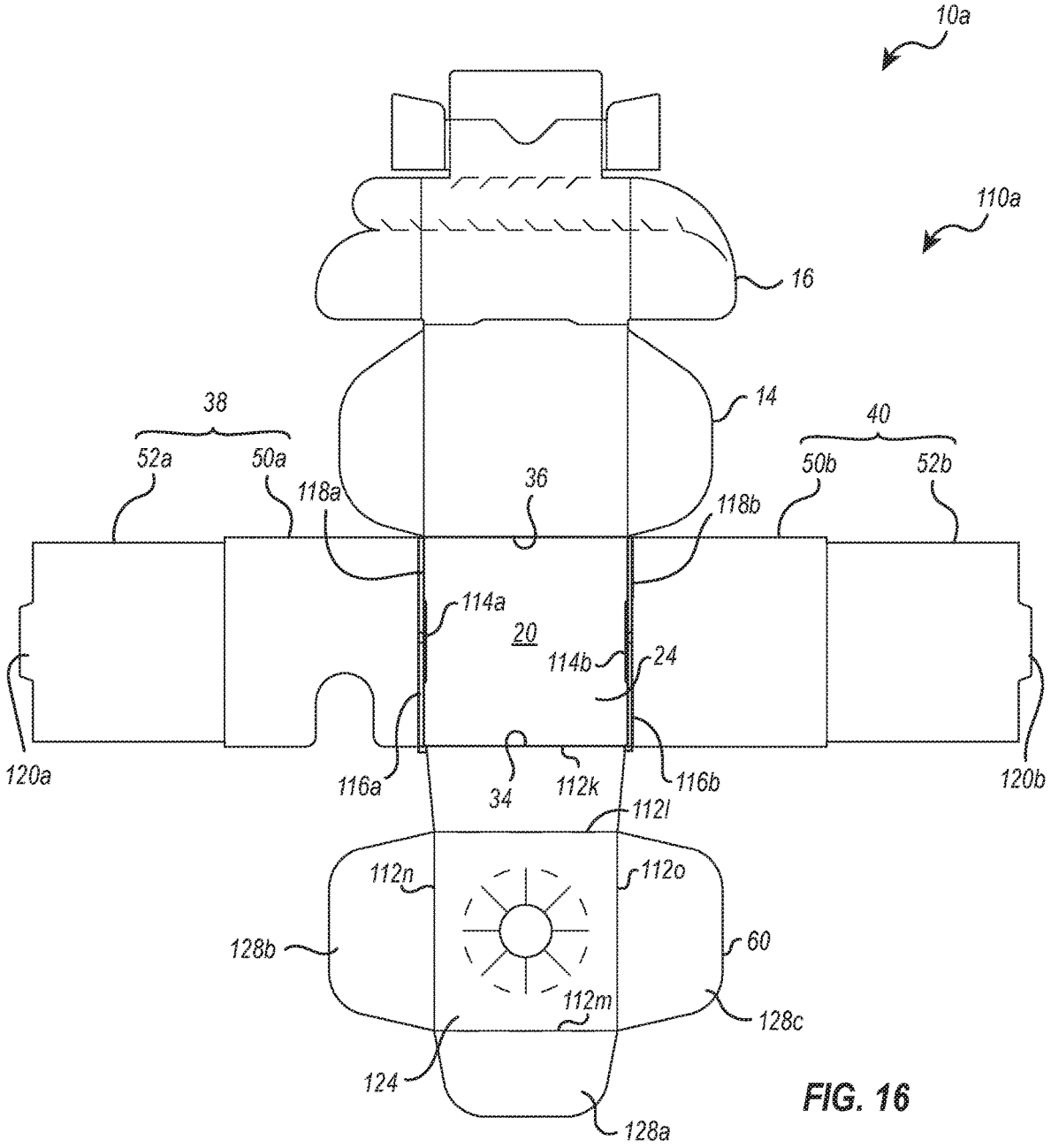
FIG. 16 is a top plan view of the template shown in FIG. 15 with the front and rear panel in an upwardly folded position.

A method of erecting template 110*a*, shown in FIG. 15, to erected zipper carton 10*a*, shown in FIG. 1, will now be discussed. Starting with template 110*a* in FIG. 15, front panel 34 and back panel 36 are both folded upward at creases 112*a* and 112*b*, respectively, so as to extend orthogonal to floor 20. In addition, tuck flaps 116*a* and 118*a* are inwardly folded into alignment and tuck flaps 116*b* and 118*b* are inwardly folded into alignment, as shown in FIG. 16.

Figure 17:
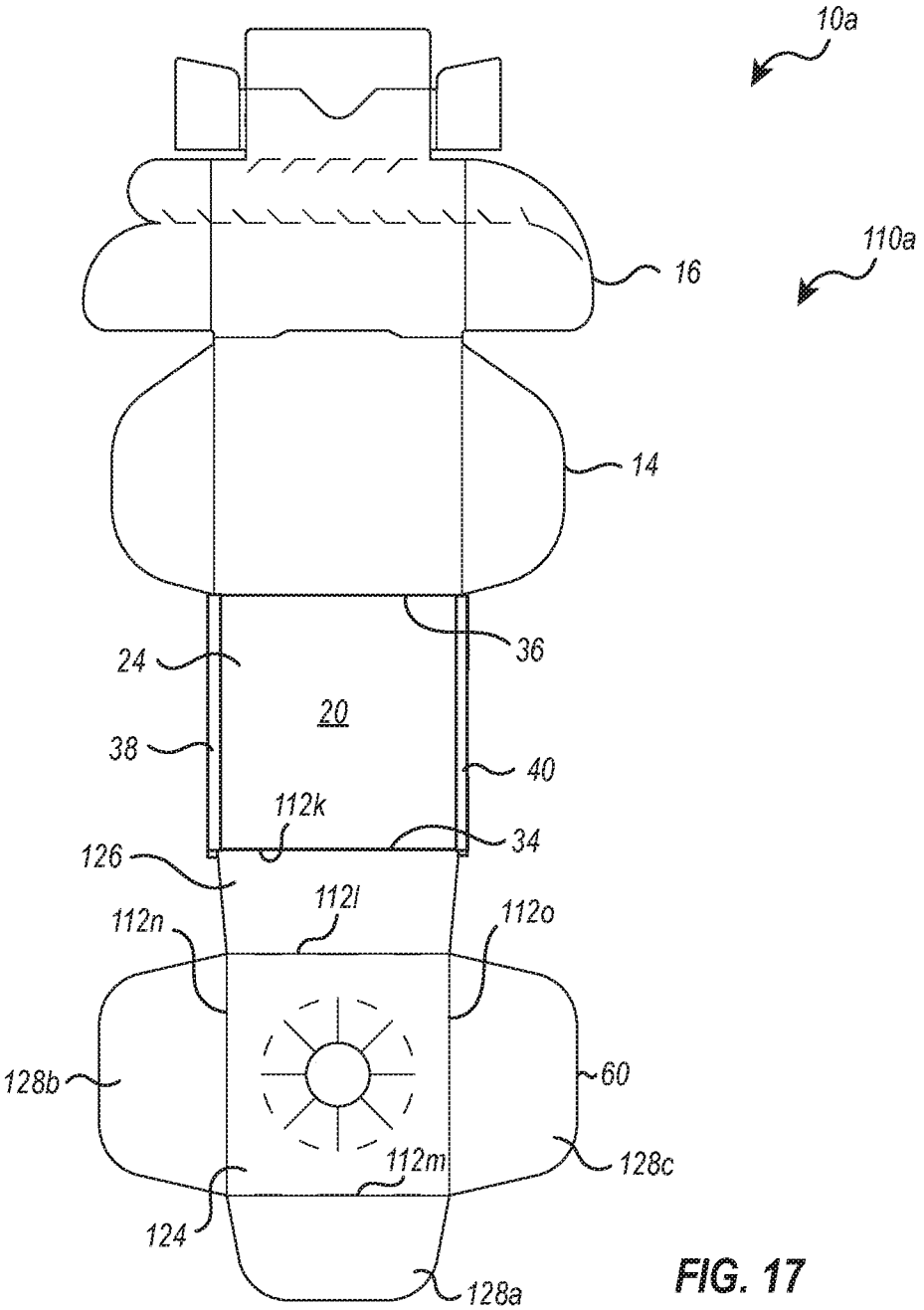
FIG. 17 is a top plan view of the template shown in FIG. 16 with the opposing side panels in an upwardly folded position.
Figure 18:
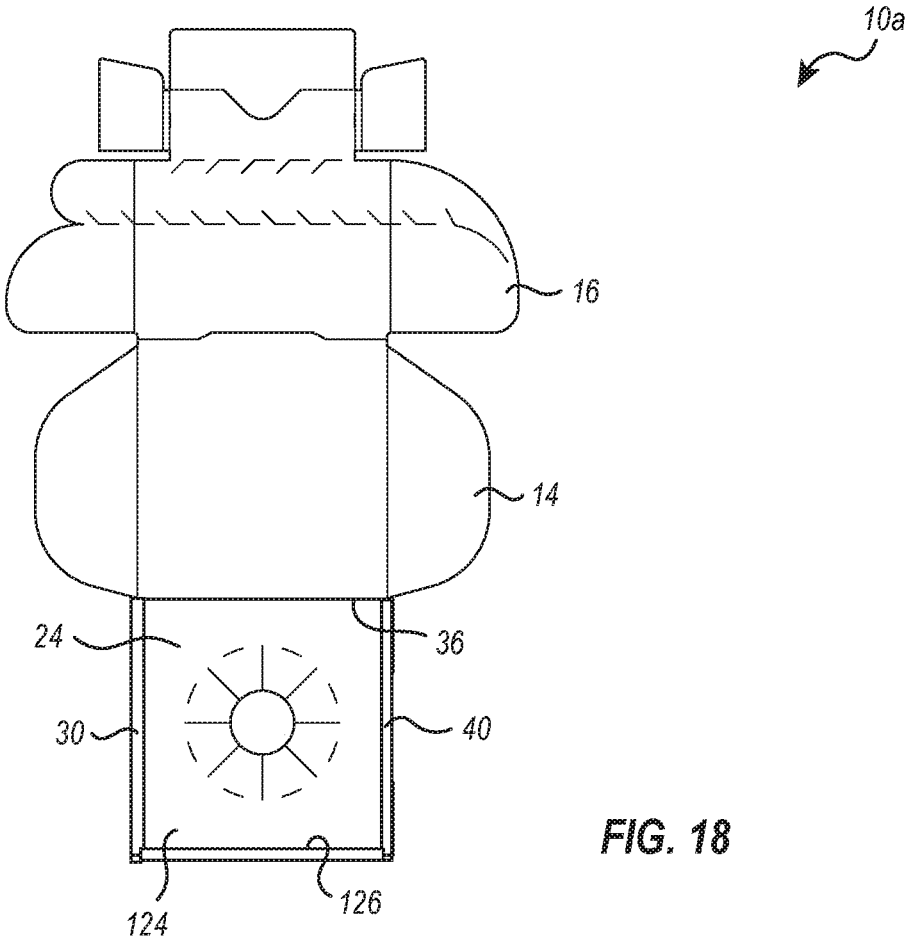
FIG. 18 is a top plan view of the template shown in FIG. 17 with the carton in a erected and open position.

Next, with reference to FIG. 17, first side panel 38 is folded over aligned tuck flaps 116*a* and 118*a* so that interior side panel 52*a* is received within compartment 24. First side panel 38 is secured in place by inserting tab 120*a* within cut slit 114*a*. Similarly, second side panel 40 is folded over aligned tuck flaps 116*b* and 118*b* so that interior side panel 52*b* is received within compartment 24. Second side panel 40 is secured in place to inserting tab 120*b* within cut slit 114*b*. Product retainer 60 can then be positioned within compartment 24 by upwardly folding support flaps 128*b* and 128*c* along creases 112*n* and 112*o* and then advancing support flaps 128*b* and 128*c* and support panel 124 into compartment 24 by folding extension panel along creases 112*k* and 112*l*. Support flap 128*a* can be folded along crease 112*m* in either direction as support panel 124 is advanced into compartment 24. The resulting open and erected zipper carton 10*a* is shown in FIGS. 1, 2, and 16. Carton 10*a* can then be moved to the closed position or the closed, locked position as previously discussed.

Figure 19:
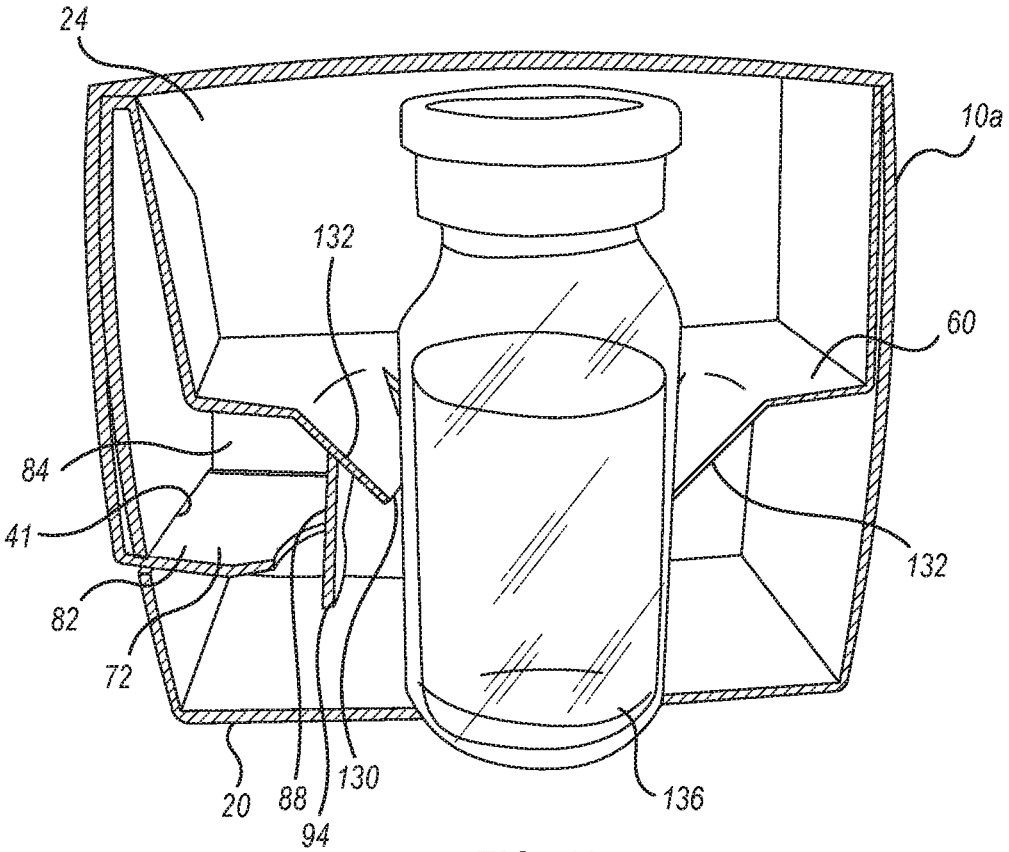
FIG. 19 is a cross-sectional side view of the zipper carton shown in FIGS. 1 and 18 with a trial product disposed therein.

One method will now be discussed as to how zipper carton 10*a* can be used for loading, delivering and dispensing a drug product or trial products for use in a blinded trial. Once flat templates 110*a* are obtained, they can be manipulated into the erected open position as discussed above and depicted in FIGS. 1 and 2. While in the erected open position, a drug product or trial product can be positioned within compartment 24 of zipper carton 10*a*. For example, as depicted in FIG. 19, where product retainer 60 is used, a drug product or trial product 136 can be push down thorough opening 130 so as to outwardly flare brace flaps 132. Drug product/trial product 136 can then rest on floor 20 while drug product/trial product 136 is laterally supported by encircling brace flaps 132.

With continued reference to FIG. 19, it is noted in this view that brace flaps 132 can be configured so that when drug product/trial product 136 is received within opening 130 and brace flaps 132 are outwardly flared, select brace flaps 132 function as a stop to limit how far retention flap 88 can rebound. More specifically, select brace flaps 132 are configured and positioned to limit the rebounding of retention flap 88 so that retention flap 88 is retained between retention flaps 84 and 86. As previously discussed with and depicted in FIG. 6, maintaining retaining retention flap 88 between retention flaps 84 and 86 helps to prevent unwanted movement of retention flaps 84 and 86 back to the folded position, which could enable removal of locking tab 72 from slot 41 (FIG. 4).

It is also noted that central projection 94 of retention flap 88 is designed to assist in the positioning of retention flap 88 between retention flaps 84 and 86. Specifically, when locking tab 72 is in the collapsed position and is initially being inserted into slot 41 (FIG. 4), projection 94 leads first into slot 41. Projection 94 is configured so that as locking tab 72 advances into slot 41 and starts to resiliently rebound into the rebound position, projection 94 hits against the side of drug product/trial product 136 (FIG. 19). As locking tab 72 continues further into slot 41, this contact between projection 94 and drug product/trial product 136, forces projection 94 downward which in turn forces the opposing end of retention flap 88 upward, thereby assisting with the rebound of retention flaps 84 and 86 and placing retention flap 88 between retention flaps 84 and 86.

Thus, folding retention flaps 84, 86, and 88 toward front face 98 of base 82 (FIG. 3) as opposing toward back face 99, when moving locking tab 72 to the collapsed position, has specific advantageous. In addition to the above, when zipper carton 10*a* is in the closed and locked position, retention flaps 84, 86, and 88 are covered by zipper tear strip 74 and extension panel 70, thereby making retention flaps 84, 86, and 88 more difficult to access for unwanted movement. However, in an alternative embodiment, retention flaps 84, 86, and 88 could be folded toward back face 99 of base 82 when moving locking tab 72 to the collapsed position. This latter configuration makes it easier to hold retention flaps 84, 86, and 88 in the folded position as locking tab 72 is inserted into slot 41.

The size and configuration of product retainer 60 can vary based upon the size, configuration and type of drug product/trial product 136 to be housed therein. As previously discussed, in at least one embodiment, trial product 136 can comprise one or more different products. For example, trial product 136 can comprise a test product that can comprise an active drug product, a comparator product, a control product, a placebo product, or one or more combinations of the foregoing. Furthermore, in different zipper cartons or in the same zipper carton, the drug product or the trial product, i.e., the active drug product, comparator product, control product, and/or placebo product, can be provided in different quantities, volumes, concentrations, strengths, types (i.e., pill, ointment, liquid, injection, etc.) or combinations of the foregoing. Furthermore, in at least one embodiment, drug product/trial product 136 can include multiple dosages or concentrations of one or more different drug products/trial products 136. Accordingly, drug product/trial product 136 can comprise a plurality of different containers and different container types being placed in the same or different zipper cartons. Depending on the form of the drug being tested, the foregoing products may be housed in pill bottles, syringes, vials, tubes or other conventional containers. For example, in FIG. 19, drug product/trial product 136 comprises a vial housing a liquid injection.

Materials inserted with drug product/trial product 136 into opening 130 can also include one or more support products such as antiseptics, band-aids, swabs, gauze, tape, instructions, disposal containers or any other accessories that may be used or associated with the drug being used or tested. Drug product/trial product 136 can be held securely within compartment 24, such as by using product retainer 60. Alternatively, product retainer 60 can be eliminated and drug product/trial product 136 and the support products can be loosely held within compartment 24.

Once drug product/trial product 136 has been properly packed within zipper carton 10*a*, zipper carton 10*a* can then be manipulated from the erected, opened position, illustrated in FIG. 1, to an erected, closed and locked position, as discussed above and illustrated in FIG. 5.

By moving zipper carton 10*a* to the closed and locked position, zipper carton 10*a*/compartment 24 becomes sealed closed so that drug product/trial product 136 cannot be seen, accessed and/or tampered with until zipper carton 10*a* is opened by the removal of zipper tear strip 74.

Either prior to, during, or after loading of drug product/trial product 136 in zipper carton 10*a*, one or more labels can be secured on the exterior and/or interior surface of zipper carton 10*a*. The labels can provide instructions, identification indicia, or other relevant information for the blinded trial or use of the drug product. Once zipper carton 10*a* is sealed closed, zipper carton 10*a* can be packaged with other zipper cartons 10 for transporting as a group or can be individually transported to a first recipient. For example, where the product is a drug product, the first recipient can be a retail store, hospital, clinic, end user, or the like. Where the product is a trial product, the first recipient may be a medical practitioner such as an administering technician or doctor. The technician/doctor can open zipper carton 10*a* by removing zipper tear strip 74 and administer the trial product 136 or deliver the zipper carton 10*a* to a second recipient for administration of the trial product 136.

In certain embodiments, filled, closed, and locked zipper cartons 10*a* can be distributed to a hospital or clinic where they can be distributed to patients either directly on site or for the patient to take home for self-administration. It will also be noted that steps of erecting zipper carton 10*a*, inserting drug products/trial product 136 therein, closing zipper carton 10*a*, locking zipper carton 10*a*, and labeling zipper carton 10*a* can be accomplished by up to five separate people. In at least one embodiment, however, a plurality of said steps is performed by the same person. For instance, in at least one embodiment, each of the foregoing steps is performed by the same person.

The locked zipper carton 10*a* is typically opened by an intended recipient, such as an administering technician of the medical practice participating in the trial or the patient receiving the dosage thereof or the end user of a drug product. As previously discussed and depicted in FIG. 7, locked zipper carton 10*a* can be opened by removing the zipper tear strip 74. For instance, first end 100 (FIG. 7) can be lifting pulled toward second end 102 so as to remove zipper tear strip 74 from locking tab 72 and from all or at least a majority of extension panel 70, thereby freeing extension panel 70 from locking tab 72. Upon complete removal of zipper tear strip 74, jagged edge 104 on extension panel 70, FIGS. 7 and 8, indicates removal of zipper tear strip 74.

Figure 8:
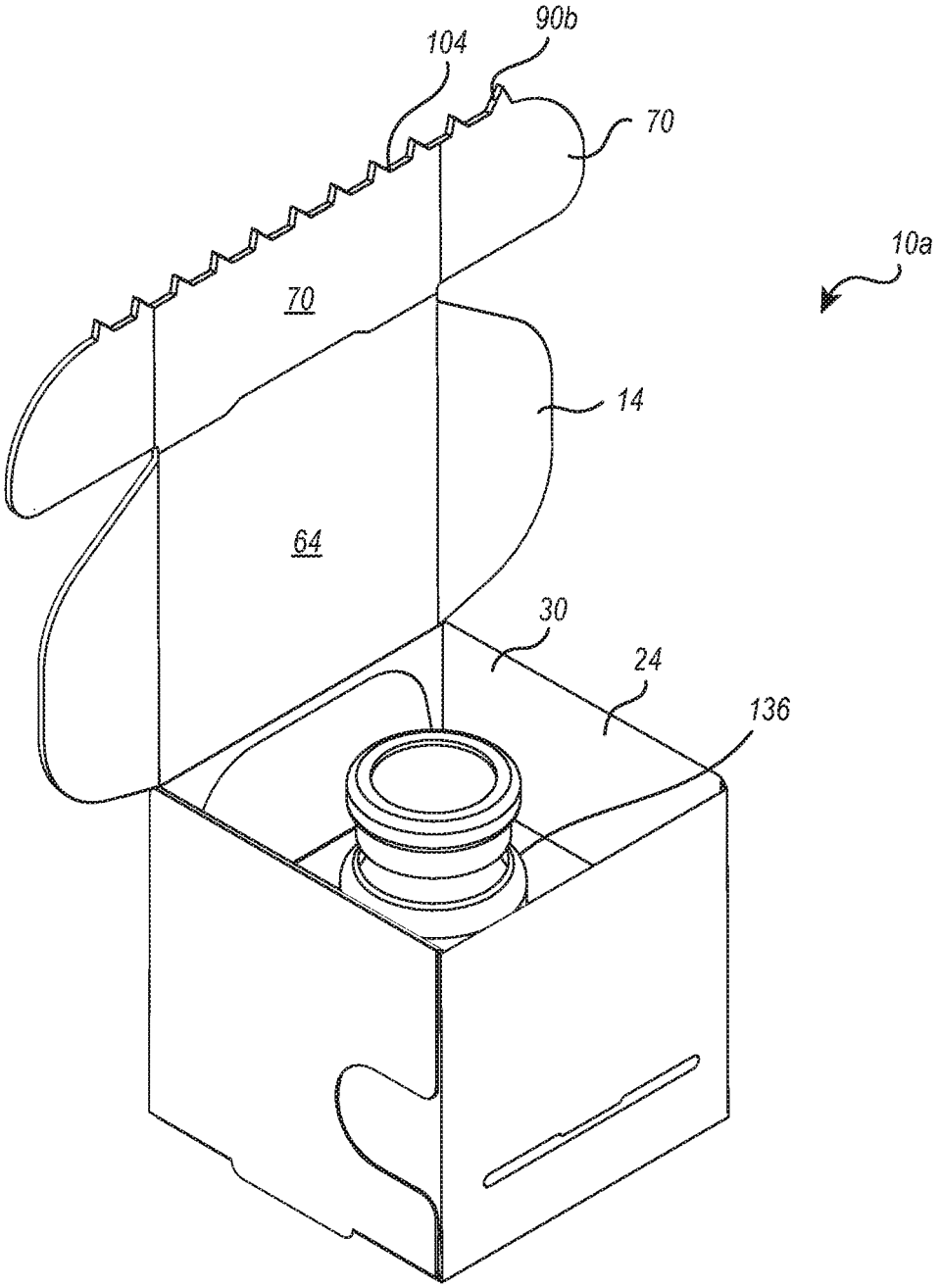
FIG. 8 is a perspective view of the zipper carton shown in FIG. 7 wherein the zipper tear strip has been fully removed and the zipper carton is in an open position.

Once zipper tear strip 74 is removed, extension panel 70 can be raised so as to withdraw tuck flaps 76 and 78 from pockets 54*a* and 54*b*, respectively. Cover panel 64 can then be raised so as to withdraw dust flaps 66 and 68 from compartment 24 and thereby provide open access to drug product/trial products 136 within compartment 24 through access opening 30, as shown in FIG. 8.

It will be appreciated that zipper carton 10*a* can be reclosed, i.e., moved back to the closed position, by reversing the foregoing steps involving dust flaps 66 and 68, cover panel 64, and tuck flaps 76 and 78. However, because locking tab 72 has been removed by the removal of zipper tear strip 74, zipper carton 10*a* cannot be moved back to the closed and locked position. However, as discussed below, a reseal panel can be attached to zipper carton 10*a* to enabling closing and locking of zipper carton 10*a*.

Figure 20:
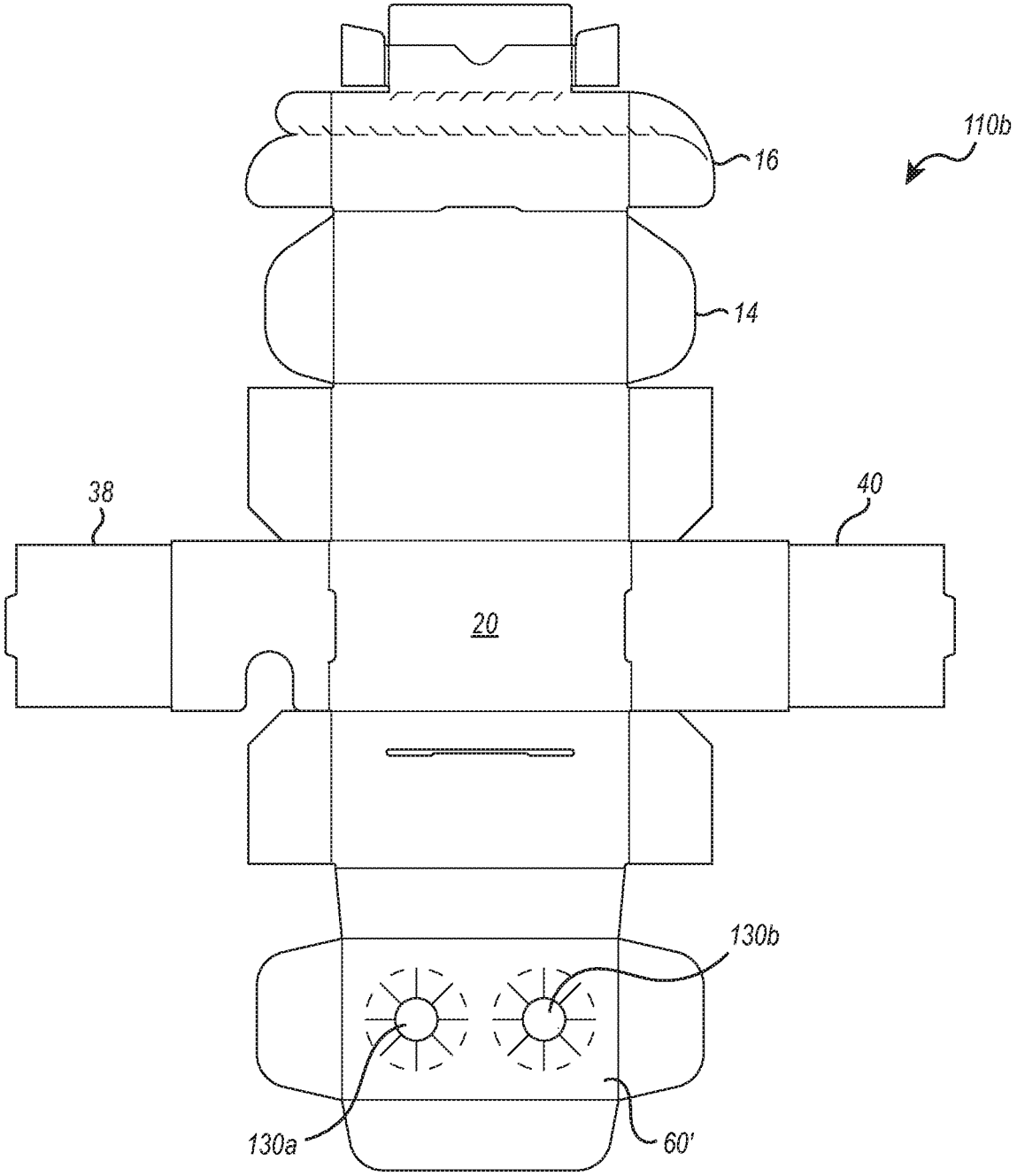
FIG. 20 is a top plan view of a flat template of an alternative embodiment of a zipper carton.

It is appreciated that zipper carton 10*a* can have a variety of different sizes and shapes depending upon the size, shape, type, and number of drug products/trial products to be housed therein. For example, the final fully assembled and closed carton body 12 can have a box shaped configuration, i.e., a parallelepiped hexahedron, having square or rectangular panels. Accordingly, with reference to FIGS. 1 and 2, panels 34, 36, 38, and 40 can be disposed at successive right angles one to another. In other embodiments, carton body 12 can have other hexahedron or polyhedron configurations or other three dimensional configurations such as cylindrical or conical. Furthermore, zipper carton 10*a* has a substantially square transverse cross section and is configured to hold a single vile. In contrast, depicted in FIG. 20 is a temple 110*b* that when erected, using the same steps as discussed above, has an elongated rectangular cross section. Like elements between templates 110*a* and 110*b* are identified by like reference characters. In contrast to template 110*a*, template 110*b* has a product retainer 60' have two spaced apart openings 130*a* and 130*b* that are configured to receive two vials. In other embodiments, a template and corresponding zipper carton can be configured to hold 3, 4, 5, or more products. Furthermore, alternative zipper cartons need not have a square or rectangular transverse cross section but could have a circular, elliptical, or polygonal transverse cross sections.

Figure 21:
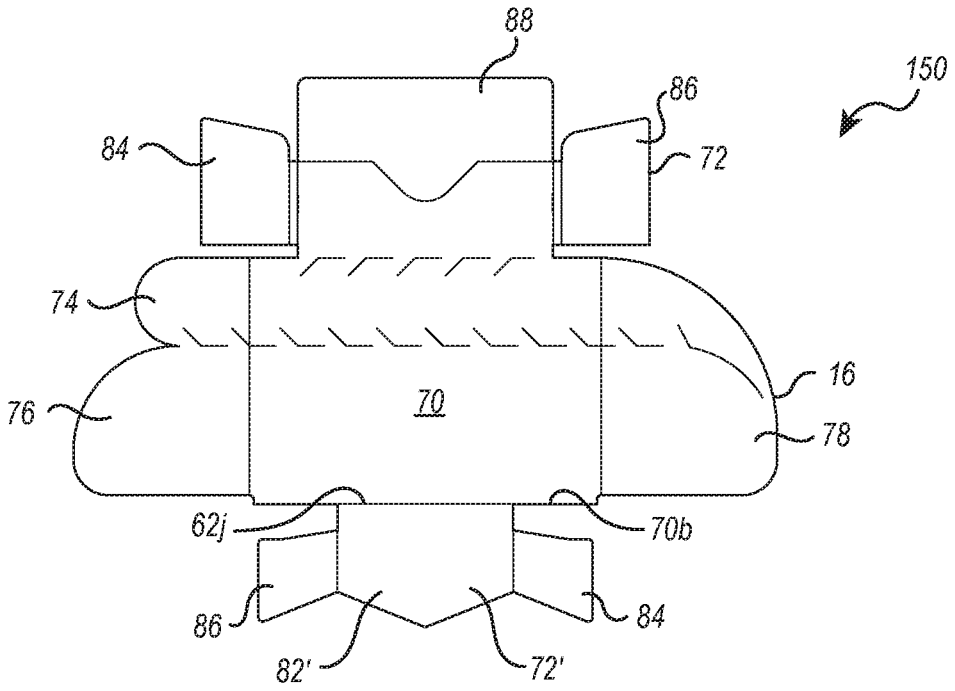
FIG. 21 is a top plan view of a flat reseal panel.

Depicted in FIG. 21 is one embodiment of a reseal panel 150 that can be used to close and lock zipper carton 10*a* after zipper tear strip 74 has been removed. Reseal panel 150 can include elements of zipper carton 10*a* and thus like elements are identified by like reference characters. Reseal panel 150 is shown as comprising locking panel assembly 16 of zipper carton 10*a* which includes extension panel 70, zipper tear strip 74 and locking tab 72, as previously discussed. For purposes of discussing reseal panel 150, locking tab 72 is hereinafter referred to as primary locking tab 72. In contrast to having cover panel assembly 14 projecting from extension panel 70, reseal panel 150 includes locking tab 72' (previously discussed with regard to FIGS. 9 and 10) centrally projecting from back edge 72*b* of extension panel 70 with a crease 62*j* being formed thereat. Again for purposes of discussing reseal panel 150, locking tab 72' is hereinafter referred to as secondary locking tab 72'. As with zipper carton 10*a*, reseal panel 150 can comprise a single, continuous, unitary structure and can be made from a sheet of material. The sheet of material can comprise the same sheet as previously discussed above with regard to the formation of zipper carton 10*a*. For example, reseal panel 150 can be cut from a single continuous sheet such as a sheet of paper.

Figure 22:
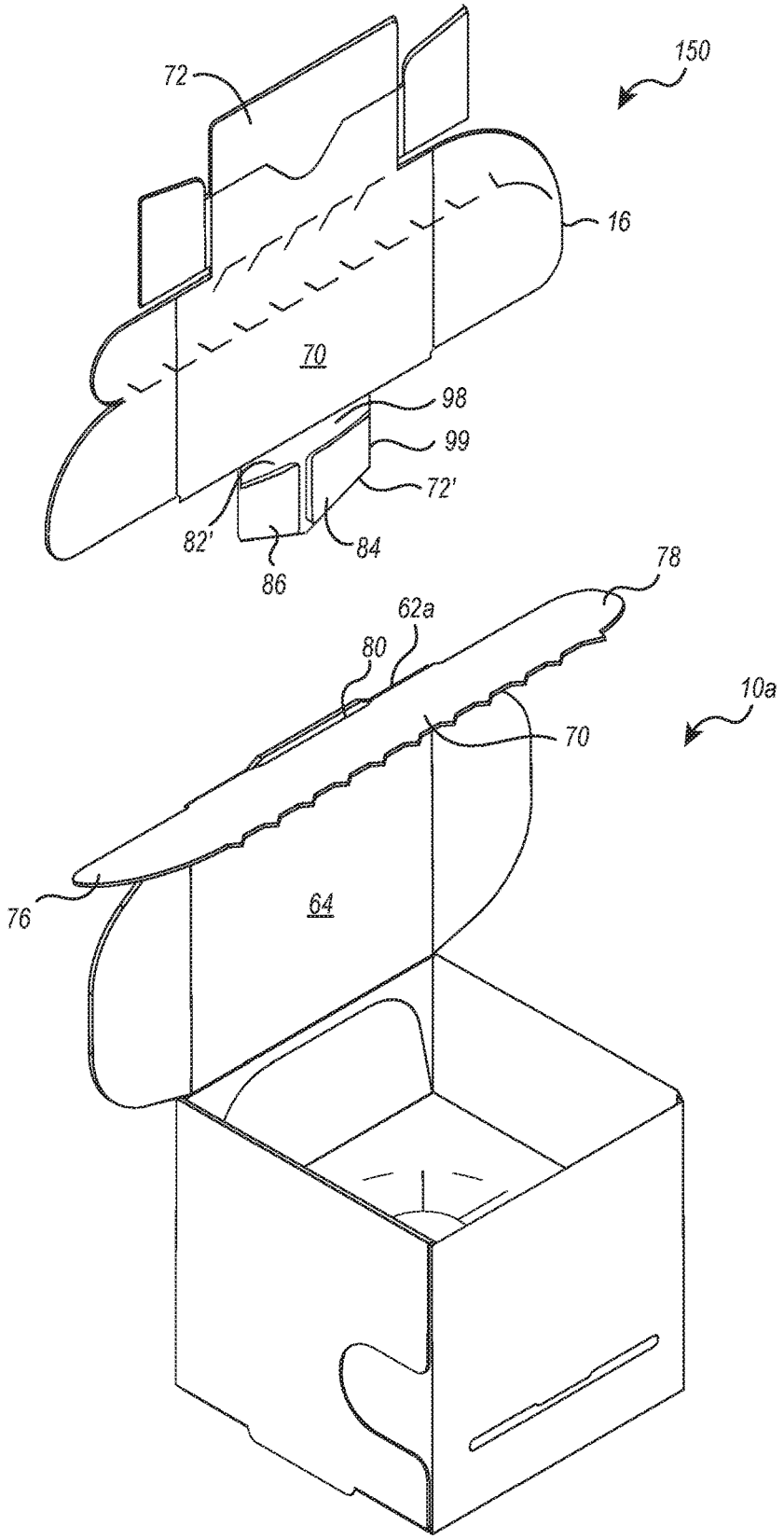
FIG. 22 is a perspective view of the reseal panel shown in FIG. 21 being aligned for coupling with the zipper carton shown in FIG. 8.
Figure 23:
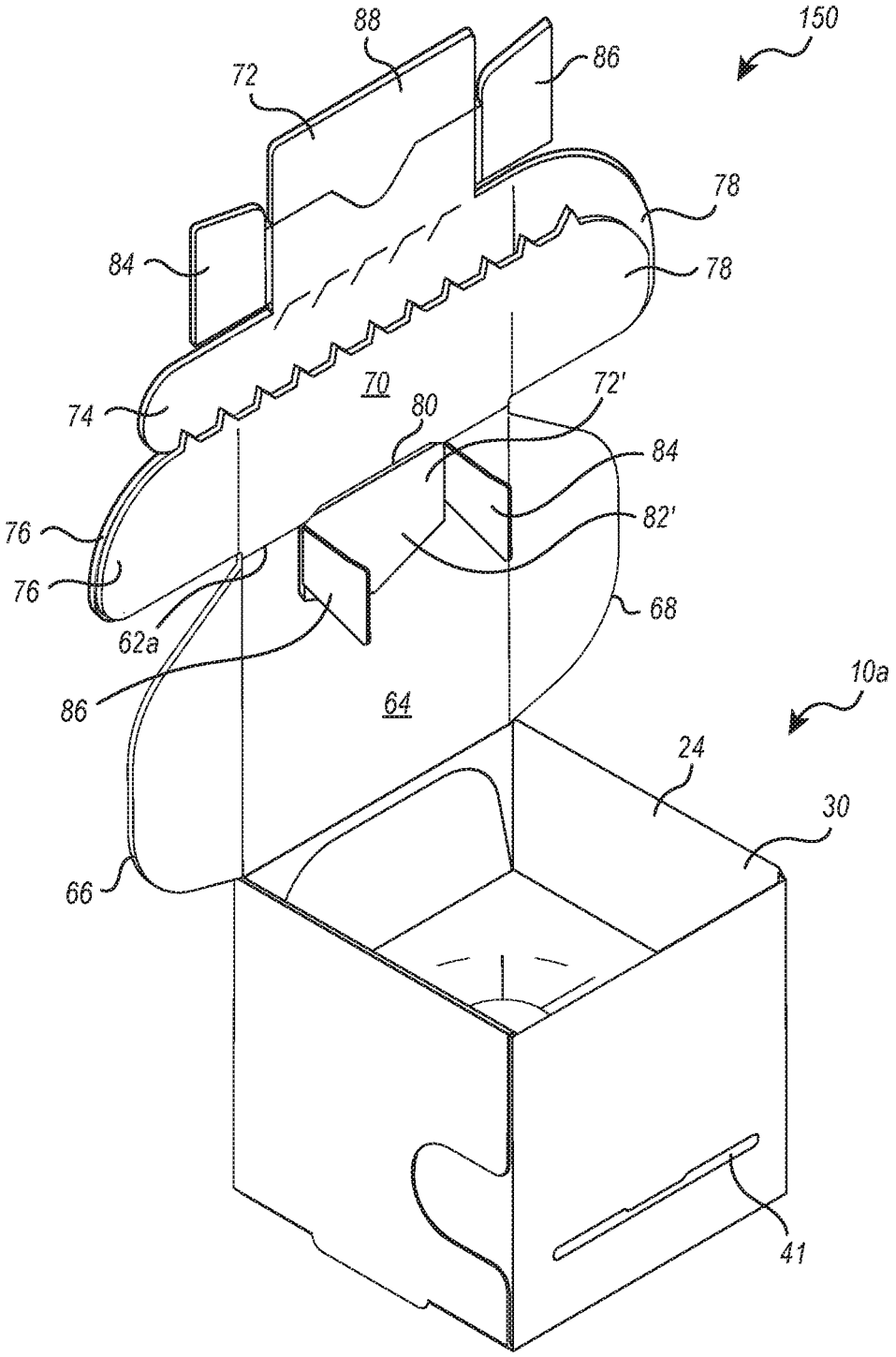
FIG. 23 is a perspective view of the reseal panel and zipper carton shown in FIG. 22 in an assembled configuration.

As depicted in FIG. 22, reseal panel 150 is configured to be used with zipper carton 10*a* after zipper tear strip 74 and locking tab 72 have been removed from zipper carton 10*a*. Reseal panel 150 enables zipper carton 10*a* to again be moved to the closed and locked position. During use, secondary locking tab 72' of reseal panel 150 is folded into a collapsed position by folding each of retention flaps 84 and 86 from a relaxed position to a folded position. Specifically, as previously discussed, retention flaps 84 and 86 are folded so as to be disposed against or adjacent to front face 98 or back face 99 of base 82'. In this collapsed position, secondary locking tab 72' of reseal panel 150 can be passed through secondary slot 80 formed at the intersection between cover panel 64 and extension panel 70, e.g., crease 62*a*, of zipper carton 10*a*, as shown in FIG. 23. It is noted that the linear length of secondary locking tab 72' between the opposing outside edges of retention flaps 84 and 86, when in the relaxed position (FIG. 21), is greater than the length of secondary slot 80 (FIG. 22) but that length of secondary locking tab 72' when in the collapsed position is equal to or smaller than the length of secondary slot 80. As secondary locking tab 72' is passed through secondary slot 80, retention flaps 84 an 86 automatically resiliently rebound to the rebound position, thereby preventing secondary locking tab 72' from pullout out of secondary slot 80 and thus securing reseal panel 150 of zipper carton 10*a*.

Figure 24:
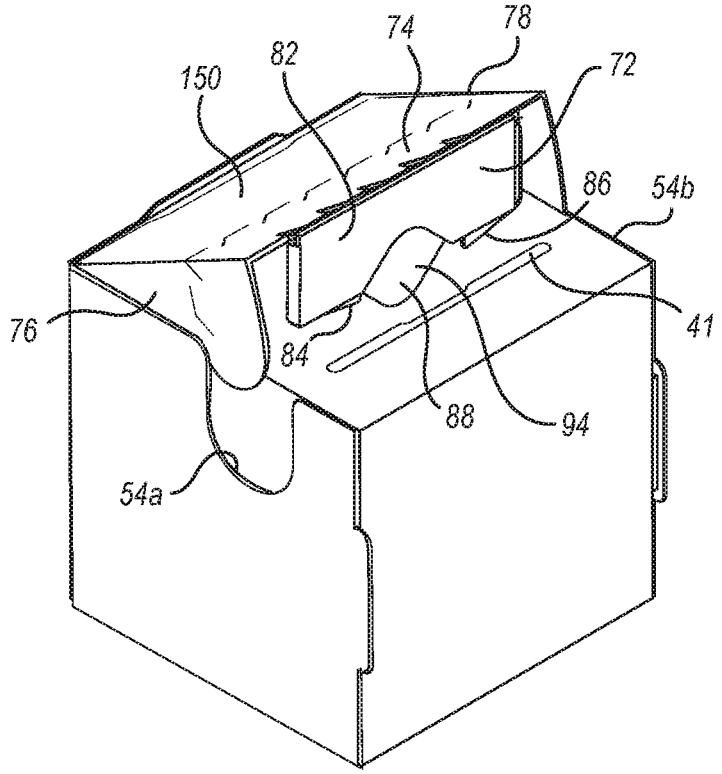
FIG. 24 is a perspective view of the assembly shown in FIG. 23 with the reseal panel in a partially closed position.

In this assembled configuration, reseal panel 150 now overlies where locking panel assembly 16 (FIG. 1) previously existed on zipper carton 10*a*. As such, reseal panel 150 can now be used to move zipper carton 10*a* back to the closed and locked position. For example, as previously discussed with the initial closing and locking of zipper carton 10*a*, optional dust flaps 66 and 68 can be inwardly folded. Cover panel 64 can then be folded over access opening 130 while dust flaps 66 and 68 are received within compartment 24. Next, as show in FIG. 24, overlapping tuck flaps 76 and 78 of zipper carton 10*a* and reseal panel 150 are inwardly folded and advanced into pockets 54*a* and 54*b*, respectively. Likewise, primary locking tab 72 of reseal panel 150 can be moved to the collapsed position by inwardly folding retention flaps 84, 86, and 88 relative to base 82 in the same way as previously discussed with regard to locking tab 72 of zipper carton 10*a*.

Figure 25:
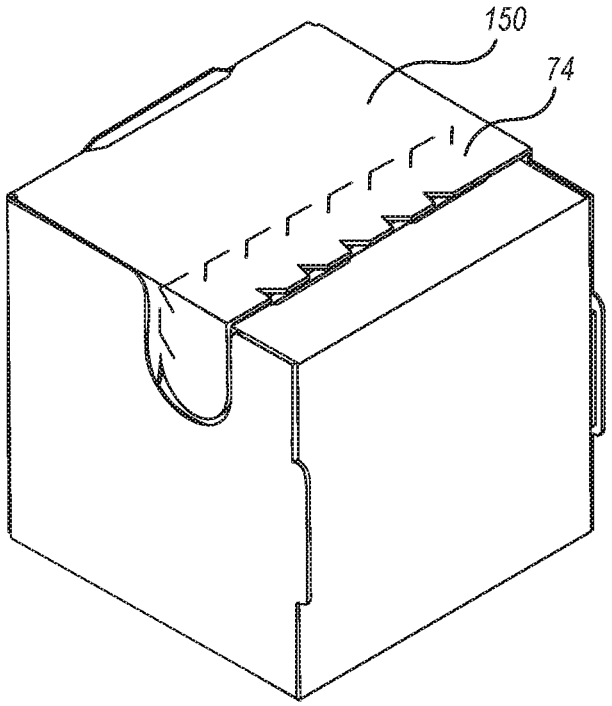
FIG. 25 is a perspective view of the assembly shown in FIG. 24 in a fully closed and locked position.
Figure 26:
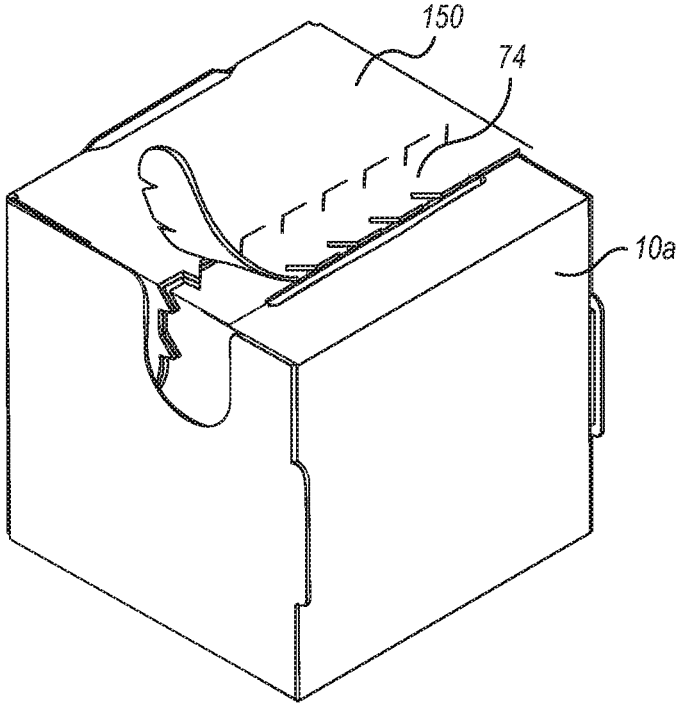
FIG. 26 is a perspective view of the assembly shown in FIG. 25 with the zipper tear strip being partially removed for opening of the zipper carton.

Collapsed primary locking tab 72 can then be advanced into slot 41 while tuck flaps 76 and 78 are being advanced into pockets 54, as shown in FIG. 25. Again, in the same way as previously discussed with regard to the initial locking of zipper carton 10*a*, retention flaps 84, 86, and 88 (FIG. 23), automatically resiliently rebound to the rebound position so as to prevent locking tab 72 from being pulled out of slot 41, thereby locking zipper carton 10*a* in the closed position. To again reopen zipper carton 10*a* coupled within reseal panel 150, zipper tear strip 74 can be removed as previously discussed and as depicted in FIG. 26. Once zipper tear strip 74 is removed and zipper carton 10*a* opened, the remainder of reseal panel 150 can be removed from zipper carton 10*a* and replaced with a new reseal panel 150 (using the same method as discussed above), thereby enabling further and repeated closing and locking and then reopening of zipper carton 10*a*.

It is appreciated that reseal panel 150 can come in a variety of different configurations. For example, primary locking tab 72 can be replaced with locking tab 72' or 72", previously discussed, and the different retention flaps thereof can be folded in either direction. Likewise, secondary locking tab 72' can be replaced with locking tab 72 or 72", previously discussed, and the different retention flaps thereof can be folded in either direction. Furthermore, as with locking panel assembly of zipper carton 10*d*, discussed and shown with regard to FIG. 13, reseal panel 150 can be formed without extension panel 70 or tuck flaps 76 and 78. In this embodiment, secondary locking tab 72' would project directly from zipper tear strip 74. Furthermore, during use, secondary locking tab 72' would be advanced into secondary slot 80 formed on cover panel 64 shown in FIG. 13. In addition, as with locking panel assembly of zipper carton 10*e*, discussed and shown with regard to FIG. 14, reseal panel 150 can be formed with extension panel 70 but without tuck flaps 76 and 78. In this embodiment, secondary locking tab 72' would centrally project from extension panel 70 and could be received within secondary slot 80 as shown in FIG. 14.

It is appreciated that the disclosed zipper cartons and reseal panels and the related methods of assembly and use have unique advantages and benefits over the prior art. For example, embodiments of the disclosed zipper carton and reseal panel are simple and inexpensive to produce, easily erected, and environmentally friendly. This is especially true where the zipper carton and reseal panel are each made from single piece template comprised of a paper product. Such zipper cartons and reseal panels avoid the need for making and assembling multiple different part.

Embodiments of the zipper carton are also unique in that no adhesive is applied to the template during manufacture of the template, thereby reducing cost, complexity and environmental concerns. In addition, no adhesive is needed to erect, close or lock the zipper cartons. An adhesive can be in the form of a tape, sticker, or independent adhesive. Eliminating adhesive from the zipper cartons simplifies use of the zipper cartons, eliminates risk or damage resulting from failure of the adhesive, such a failure of the adhesive due to freezing, limits waste since removable cover strips are no longer needed to be placed over the adhesive layer, and makes disposable of the zipper carton more environmentally friendly. The same benefits also apply to the reseal panels that require no adhesive to be applied during manufacture and no use of adhesive during use.

Embodiments of the zipper carton, with our without the reseal panel, are also unique in that they can be closed and locked without the required use of a tool or machine. Furthermore, once the zipper cartons are locked, they can be difficult if not impossible to open without removal of the zipper tear strip or destroying part of the carton. As such, the zipper cartons are an effective tamper evident carton. That is, they provide a clear indication when a carton has been opened and can produce clear indications as to when attempts have been made to open the carton. The zipper cartons also completely and securely shield the trial product so as to eliminate any ability to inspect the trial product within the locked zipper carton.

Embodiments of the zipper cartons, with or without the reseal panel, are also unique in that the erected, closed and locked zipper cartons consistently having identical configurations, thereby improving the integrity of the related blinded studies. In contrast, cartons closed by adhesive can often have discrepancies between cartons that can lead to actual or implied assumptions as to the trial product contained therein.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, processes, and/or products according to certain embodiments of the present disclosure may include, incorporate, or otherwise comprise properties features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, processes, products, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A zipper carton comprising:

a first panel having an elongated slot extending therethrough, the slot includes a first end opposite a second end and a tab that projects into the slot, the slot defines a length extending between the first and second ends, and the slot defines a first slot width at the tab, a second slot width between the first end and the tab, and a third slot width between the second end and the tab, the first slot width is narrower than the second slot width and the third slot width; and a locking panel assembly comprising:

a removable zipper tear strip; and a locking tab having a linear length that is greater than the length of the slot, the locking tab comprising:

a base having a front edge, an opposing back edge, and a first side edge and a second side edge that both extend between the front edge and the back edge, the base projecting from the removable zipper tear strip;

a first retention flap projecting from the first side edge of the base and being foldable relative to the base;

a second retention flap projecting from the second side edge of the base and being foldable relative to the base; and a third retention flap projecting from the front edge of the base and being foldable relative to the base, wherein the locking tab is configured such that, in response to folding the first retention flap, the second retention flap, and the third retention flap from a relaxed position to a folded position, at least a portion of the locking tab including the first retention flap, the second retention flap, and the third retention flap is configured to slide through the slot and, after the first retention flap, the second retention flap, and the third retention flap pass through the slot, the first retention flap, the second retention flap, and the third retention flap automatically resiliently rebound at least partially toward the relaxed position so as to block retraction of the locking tab from the slot, and wherein the first retention flap and a portion of the third retention flap are configured to slide through the slot between the first end and the tab, the second retention flap and a portion of the third retention flap are configured to slide through the slot between the second end and the tab, and a portion of the third retention flap is configured to slide through the portion of the slot at the tab.

2. The zipper carton as recited in claim 1, wherein the base of the locking tab has a front face and an opposing back face that longitudinally extend between the first side edge and the opposing second side edge.

3. The zipper carton as recited in claim 2, wherein the base has a linear length extending between the opposing first and second side edges, the linear length of the base being equal to or smaller than the length of the slot.

4. The zipper carton as recited in claim 1, further comprising:

an encircling sidewall that partially bounds a compartment, the encircling sidewall having an upper end that bounds an access opening to the compartment and an opposing lower end;

a floor disposed at the lower end of the encircling sidewall; and the locking panel assembly being connected to the encircling sidewall.

5. The zipper carton as recited in claim 4, further comprising:

a cover panel assembly projecting from the encircling sidewall, the cover panel assembly being configured to extend over and at least partially cover the access opening;

the locking panel assembly projecting from the cover panel assembly; and the first panel comprising a front panel of the encircling sidewall, the slot extending through the front panel.

6. The zipper carton as recited in claim 5, wherein a secondary slot is formed at or adjacent to an intersection between the cover panel assembly and the locking panel assembly.

7. The zipper carton as recited in claim 4, further comprising:

the first panel projecting directly from a front panel the encircling sidewall, the first panel being configured to extend over and at least partially cover the access opening; and the locking panel assembly projecting directly from a back panel of the encircling sidewall.

8. A zipper carton in a closed and locked position, comprising:

the zipper carton as recited in claim 1; and at least a portion of the locking tab including the first retention flap, second retention flap, and third retention flap being passed through the slot, the first retention flap and second retention flap being angled relative to the base so as to block retraction of the locking tab out of the slot.

9. A method for closing a zipper carton, the method comprising:

providing the zipper carton as recited in claim 1;

folding the first retention flap, the second retention flap and the third retention flap from the relaxed position to the folded position;

passing the locking tab including the first retention flap, the second retention flap and the third retention flap through the slot; and allowing the first retention flap, the second retention flap and the third retention flap to automatically resiliently rebound at least partially toward the relaxed position so as to block retraction of the locking tab from the slot.

10. The method as recited in claim 9, wherein the third retention flap is blocked by a product retainer as it resiliently rebounds at least partially toward the relaxed position.

11. The method as recited in claim 9, wherein the third retention flap is disposed between the first retention flap and the second retention flap after automatically resiliently rebounding at least partially toward the relaxed position so as to block the first retention flap and the second retention flap from being folded back to the folded position.

12. The method as recited in claim 9, wherein the third retention flap is folded to the folded position before the first retention flap and the second retention flap are folded to the folded position.

13. The zipper carton as recited in claim 1, wherein the front edge of the base extends between a first end and an opposing second end, a slit extending completely through the front edge at a central location between the first end and the second end of the front edge.

14. A zipper carton comprising:

a first panel having an elongated slot extending therethrough, the slot includes a first end opposite a second end and a tab that projects into the slot, the slot defines a length extending between the first and second ends, and the slot defines a first slot width at the tab, a second slot width between the first end and the tab, and a third slot width between the second end and the tab, the first slot width is narrower than the second slot width and the third slot width; and a locking panel assembly comprising:

a removable zipper tear strip; and a locking tab having a linear length that is greater than the length of the slot, the locking tab comprising:

a base having a front edge, an opposing back edge, and a first side edge and a second side edge that both extend between the front edge and the back edge, the base projecting from the removable zipper tear strip;

a first retention flap projecting from the first side edge of the base and being foldable relative to the base;

a second retention flap projecting from the second side edge of the base and being foldable relative to the base; and a third retention flap projecting from the front edge of the base and being foldable relative to the base, the third retention flap including a projection configured to pivot relative to the base in response to folding the third retention flap relative to the base, wherein the locking tab is configured such that in response to folding the first retention flap, the second retention flap, and the third retention flap from a relaxed position to a folded position, at least a portion of the locking tab including the first retention flap, the second retention flap, the third retention flap, and the projection is configured to slide through the slot and after the first retention flap, the second retention flap, the third retention flap, and the projection pass through the slot, the first retention flap, the second retention flap, and the third retention flap automatically resiliently rebound at least partially toward the relaxed position so as to block retraction of the locking tab from the slot, and wherein the projection is configured to slide into the slot before the first retention flap, the second retention flap, and the third retention flap.

15. The zipper carton of claim 14, wherein the projection is defined by a slit through the third retention flap.

16. The zipper carton of claim 15, wherein the projection is received by a notch, the slit is positioned between the projection and the notch.

17. The zipper carton of claim 14, wherein the projection has a rounded V-shaped profile.

18. The zipper carton of claim 14, wherein the zipper carton is configured to store a product, and wherein the projection is configured to contact the product as the at least a portion of the locking tab is slid through the slot.

19. The zipper carton of claim 18, wherein the projection contacting the product assists the first retention flap, the second retention flap, and the third retention flap to resiliently rebound at least partially toward the relaxed position.

20. The zipper carton as recited in claim 1, wherein the first retention flap, the second retention flap, and the third retention flap each resiliently rebound into an orthogonal orientation relative to the base after passing through the slot.

* * * * *